US010792546B2

(12) United States Patent
Wang et al.

(10) Patent No.: US 10,792,546 B2
(45) **Date of Patent: *Oct. 6, 2020**

(54) GOLF GRIP

(71) Applicant: EATON INTELLIGENT POWER LIMITED, Dublin (IE)

(72) Inventors: Edward Wang, Tainan (TW); Alex Walls, Laurinburg, NC (US); Wen-Chen Su, Pinehurst, NC (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/549,539

(22) Filed: Aug. 23, 2019

(65) Prior Publication Data

US 2019/0374825 A1 Dec. 12, 2019

Related U.S. Application Data

(63) Continuation of application No. 16/028,575, filed on Jul. 6, 2018, now Pat. No. 10,391,372, which is a continuation of application No. 15/358,499, filed on Nov. 22, 2016, now Pat. No. 1,001,665, which is a continuation of application No. 14/882,797, filed on Oct. 14, 2015, now Pat. No. 9,533,203.

(60) Provisional application No. 62/065,728, filed on Oct. 19, 2014.

(51) Int. Cl.

| | |
|---|---|
| ***A63B 53/14*** | (2015.01) |
| ***A63B 60/08*** | (2015.01) |
| ***A63B 60/14*** | (2015.01) |
| ***A63B 49/08*** | (2015.01) |
| *A63B 60/00* | (2015.01) |
| *A63B 71/06* | (2006.01) |

(52) U.S. Cl.

CPC ..... *A63B 53/14* (2013.01); *A63B 49/08* (2013.01); *A63B 60/08* (2015.10); *A63B 60/14* (2015.10); *A63B 2060/002* (2015.10); *A63B 2071/0655* (2013.01)

(58) Field of Classification Search

CPC ..... A63B 53/14; A63B 60/14; A63B 60/08; A63B 60/00; A63B 2209/00; A63B 2060/002; A63B 49/08

USPC ..... 473/298, 300

See application file for complete search history.

(56) References Cited

U.S. PATENT DOCUMENTS

| | | | | |
|---|---|---|---|---|
| 4,819,939 | A | 4/1989 | Kobayashi | |
| 5,460,372 | A | 10/1995 | Cook | |
| 6,872,157 | B2 | 3/2005 | Falone et al. | |
| 7,048,644 | B2 | 5/2006 | Wang | |
| 7,458,903 | B2 | 12/2008 | Wang et al. | |
| 7,798,912 | B2 | 9/2010 | Kou | |
| 8,323,433 | B1 | 12/2012 | Lowry et al. | |
| 8,541,497 | B2 | 9/2013 | Lamkin et al. | |
| 9,533,203 | B2 | 1/2017 | Wang et al. | |
| 10,391,372 | B2 * | 8/2019 | Wang | A63B 60/14 |

(Continued)

OTHER PUBLICATIONS

Dong et al., Vibration Energy Absorption (VEA) in Human Fingers-hand-arm System, Medical Engineering & Physics 26 (2004) 483-492.

*Primary Examiner* — John E Simms, Jr.
(74) *Attorney, Agent, or Firm* — Dawsey Co., LPA; David J. Dawsey

(57) ABSTRACT

A golf grip composed of multiple rubber compounds producing desirable properties within the golf grip.

20 Claims, 22 Drawing Sheets

(56) References Cited

U.S. PATENT DOCUMENTS

| | | | | |
|---|---|---|---|---|
| 2003/0207241 | A1 | 11/2003 | Manual et al. | |
| 2004/0031127 | A1* | 2/2004 | Chen | A63B 49/08 16/436 |
| 2004/0115397 | A1* | 6/2004 | Wang | A63B 49/08 428/138 |
| 2004/0121850 | A1 | 6/2004 | Rohrer | |
| 2004/0224151 | A1 | 11/2004 | Horacek | |
| 2005/0020374 | A1* | 1/2005 | Wang | A63B 53/14 473/300 |
| 2006/0009304 | A1* | 1/2006 | Tremulis | A63B 53/14 473/300 |
| 2009/0075747 | A1 | 3/2009 | Kou | |
| 2010/0077568 | A1* | 4/2010 | Gill | A63B 49/08 16/421 |
| 2012/0129624 | A1* | 5/2012 | Ito | A63B 53/14 473/303 |
| 2013/0035436 | A1 | 2/2013 | Lamkin et al. | |
| 2013/0079173 | A1* | 3/2013 | Wu | A63B 53/14 473/300 |
| 2016/0107052 | A1 | 4/2016 | Wang et al. | |

* cited by examiner

GOLF GRIP

CROSS-REFERENCE TO RELATED APPLICATIONS

This application is a continuation of U.S. nonprovisional application Ser. No. 16/028,575, filed on Jul. 6, 2018, which is a continuation of U.S. nonprovisional application Ser. No. 15/358,499, filed on Nov. 22, 2016, which is a continuation of U.S. nonprovisional application Ser. No. 14/882,797, filed on Oct. 14, 2015, now U.S. Pat. No. 9,533,203, which claims priority to U.S. provisional patent application Ser. No. 62/065,728, filed on Oct. 19, 2014, all of which is incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present disclosure relates generally to grips and, more particularly, to hand grips for sporting implements.

BACKGROUND OF THE INVENTION

There are many different types of grips used today for a wide variety of items, including without limitation, golf clubs, tools (hammer handles, screwdrivers, etc.), racquets (racquet ball, squash, badminton, or tennis racquets), bats (baseball or softball), pool cues, umbrellas, fishing rods, etc. While particular reference for this disclosure is being made to the application of golf club grips, it should be immediately apparent that the present disclosure is applicable to other grips as well.

Slip-on golf club grips made of a molded rubber material or synthetic polymeric materials are well known and widely used in the golf industry. The term "slip-on" as employed herein refers to a grip that slides on to a shaft or handle and is secured by way of an adhesive, tape, or the like. Slip-on grips are available in many designs, shapes, and forms.

Golf club grips historically have been made of a wide variety of materials such as leather wrapped directly on the handle or leather wrapped on sleeves or underlistings that are slipped on to the handle, or more recently rubber, polyurethane or other synthetic materials are used. Efforts to date have largely focused on reducing the vibrations transmitted from the shaft to the golf grip. Such reduced vibration transmission also reduces the feel of a golf club and does not provide the golfer with sufficiently accurate tactile feedback, which is particularly true for a putter. The golfer may describe the lack of feedback as producing a hollow, muffled, or disconnected feeling.

Up until now, various construction methods have been used to produce a lower overall material density. Most commonly, an inner structure is formed using a light weight foam material, often EVA foam. Over this structure, a gripping layer is located and held in place through the use of either an adhesive or some other bonding method. Most commonly, this gripping layer is made from a felt material where the outside is coated in polyurethane to provide a smoother and more durable outer layer.

The limitations of this construction is that there is lower vibration transmission through a putter grip of this variety versus a standard sized grip of traditional construction, primarily due to the construction, materials utilized, and method of manufacture. There are a number of issues related to the lower vibration transmission, however an important one is associated with the amount of vibration which reaches the hands of the user (golfer) during the act of putting a golf ball. Putting is a relatively low energy event and any loss of vibration transmission will result in the feel of impact being deadened. This deadening of impact causes the user to have less indication of how well they impacted the ball and greatly reduces the "feel." Golfers use this "feel" as feedback to be able to improve the quality of their ball impact, thus the existing grips actually remove some of the golfers' ability to improve. Golfers describe this experience as being "isolated" or "detached" and this makes it very difficult to know if a certain action, or impact, has been repeated or not. Additionally, the "feel" of golf ball impact is, to some golfers, part of the enjoyment of playing golf and, by removing this "feel", the level of enjoyment may be reduced.

Another existing method of manufacturing a lightweight structure to form a grip is to use expanded foam/sponge material tubes (EVA, nitrile rubber, etc.) and grind them to shape. The material properties of these tubes are such that they are sold for their vibration reducing properties and therefore have the same issue as the aforementioned grips. These foam/sponges also have relatively low abrasion and UV resistance, and tend to wear out more quickly than traditional rubber grips.

Thus, there still exists a need for a hand grip that preferentially promotes transmission of vibration through the structure to the human hands holding the grip, particularly a grip that efficiently transmits vibrations in the frequency spectrum within which human hands are most sensitive.

SUMMARY OF THE INVENTION

A grip with enhanced vibration transmission produced via unique density relationships within regions of the grip. In one embodiment the grip is formed of multiple layers consisting of rubber compounds that joined together in a compression molding process. In a further embodiment the layers may have differing quantities of blowing agent to achieve the desired densities and vibration promotion. The grip may further include a tip-to-shaft connector with a density selected to further promote the transmission of vibration to the outer surface of the grip.

BRIEF DESCRIPTION OF THE DRAWINGS

Without limiting the scope of the present invention as claimed below and referring now to the drawings and figures:

Figure 1:
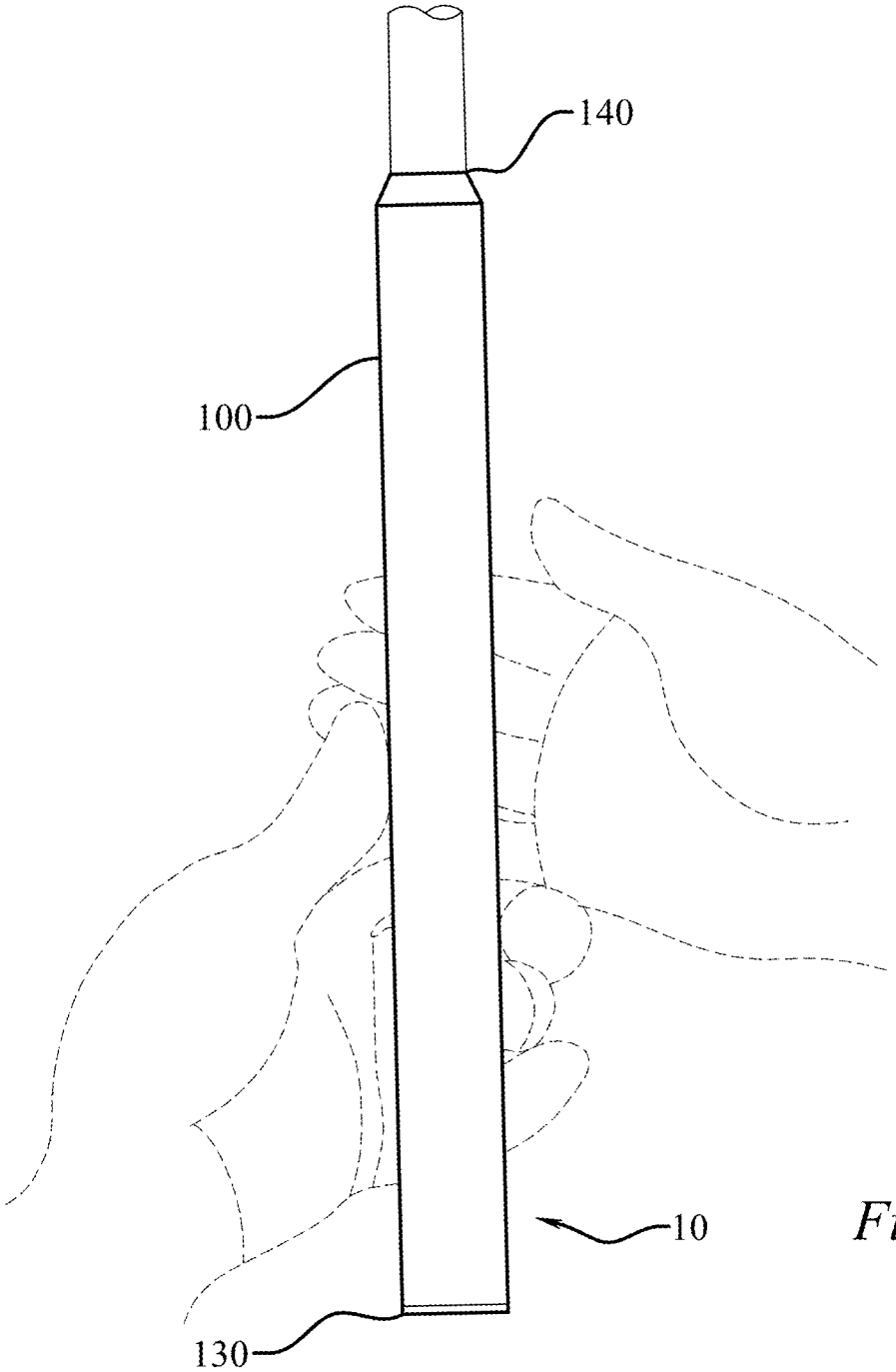
FIG. 1 shows a top view of an embodiment of the golf grip, not to scale.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The present invention enables a significant advance in the state of the art. The preferred embodiments of the invention accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention. The present disclosure is described with reference to the accompanying drawings with preferred embodiments illustrated and described. The disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout the disclosure and the drawings. In the figures, the thickness of certain lines, layers, components, elements or features may be exaggerated for clarity. Broken lines illustrate optional features or operations unless specified otherwise. All publications, patent applications, patents, and other references mentioned herein are incorporated herein by reference in their entireties. Even though the embodiments of this disclosure are particularly suited as golf club grips and reference is made specifically thereto, it should be immediately apparent that embodiments of the present disclosure are applicable to other grips for implements.

Figure 2:
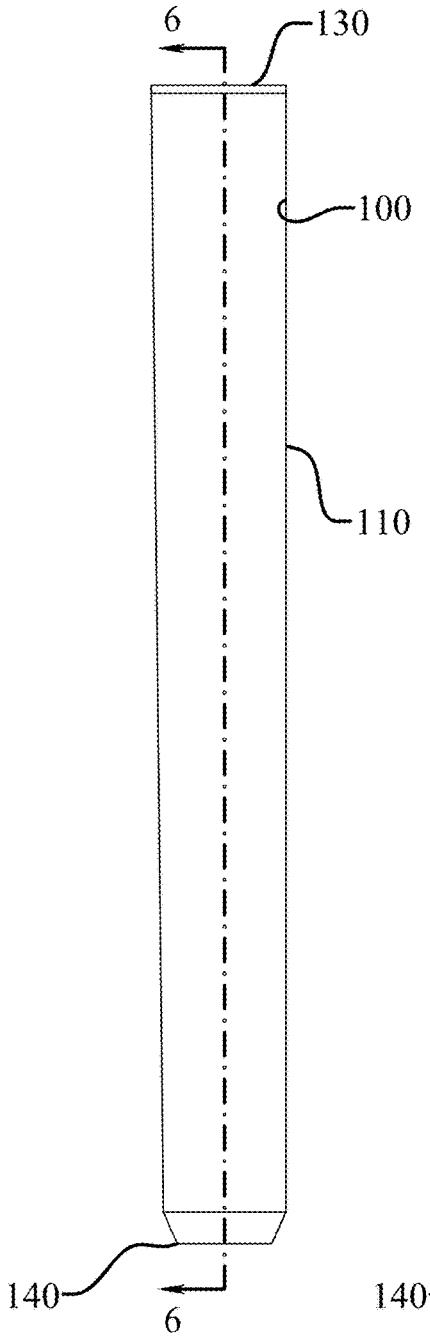
FIG. 2 shows a side elevation view of an embodiment of the golf grip, not to scale.
Figure 3:
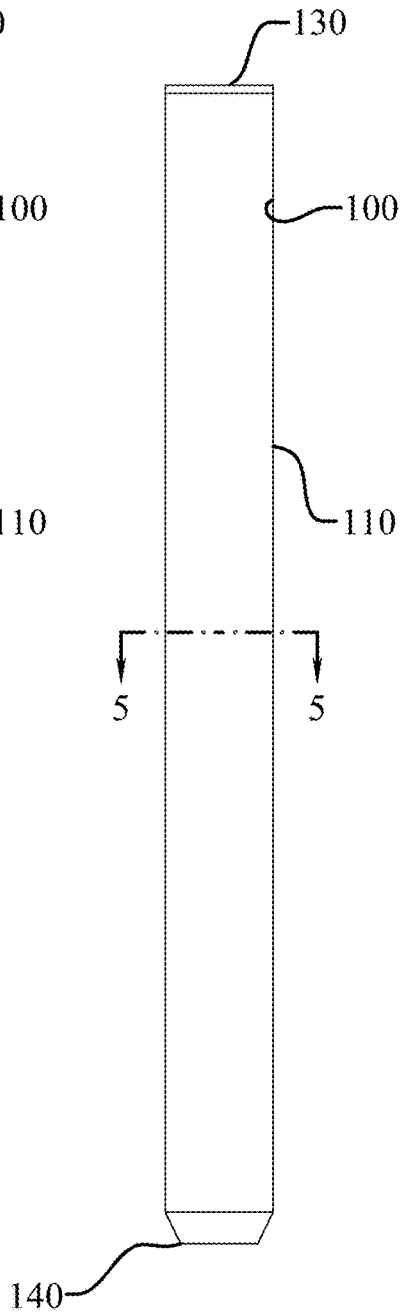
FIG. 3 shows a front elevation view of an embodiment of the golf grip, not to scale.
Figure 4:
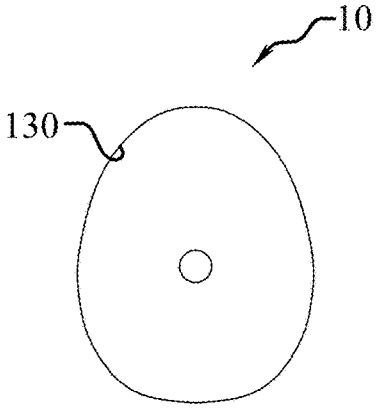
FIG. 4 shows a top plan view of an embodiment of the golf grip, not to scale.

Referring to FIG. 1, a golf grip (10) is situated in the open hands of a right-handed golfer in a traditional gripping manner. The term "right-handed" as employed herein is intended to mean someone who uses their right hand as their primary or dominant hand of choice in activities which include but are not limited to the hand they use for throwing a ball, writing, swinging a racket, a bat, or a golf club. The term "left-handed" as used herein would mean the opposite hand in these types of activities. As seen in FIGS. 2 and 3, the golf grip (10) has a structure which includes a hollow tubular body (100) with an exterior surface (110), an interior surface (120), a butt end (130), and a tip end (140). In the traditional gripping fashion of FIG. 1 an open left hand of a golfer is positioned towards the butt end (130) of the grip (10), and an open right hand is positioned towards the tip end (140), or open end, of the grip (10). In this gripping manner a couple of fingers may interlock when forming the closed grip on the golf grip (10), however one skilled in the art will appreciate that other nontraditional gripping methods such as a cross-handed grip, claw grip, saw grip, and pencil grip, just to name a few, may be utilized. Of course, each individual and the best hand position will vary with the golfer based on these and on a wide variety of golfing conditions such as weather and the golf course. Other factors include but are not limited to grip feel, golf club, shaft composition, weight of the club head, and even the size of the hands of the golfer. Naturally, for a left-handed person the placement of the hands is generally opposite that of a right-handed person. Hand placement on a golf grip is an important factor in a golf swing, whether it is a full swing or a putting stroke. Hand placement can influence the distance and direction of the travel of the golf ball.

Another important factor in the golf swing is the ability to have proper grip feel, both tactile feel when holding the golf grip (10) and the feedback feel associated with the club head (H) striking a golf ball. Efforts to date have largely focused on enhancing the vibration damping, or reducing the vibration transmission, characteristics of the golf grip (10). Such reduced vibration transmission diminishes the feedback feel and does not provide the golfer with sufficiently accurate tactile feedback, which is particularly true for a putter. The golfer may describe the lack of feedback as producing a hollow, muffled, or disconnected feeling.

Figure 5:
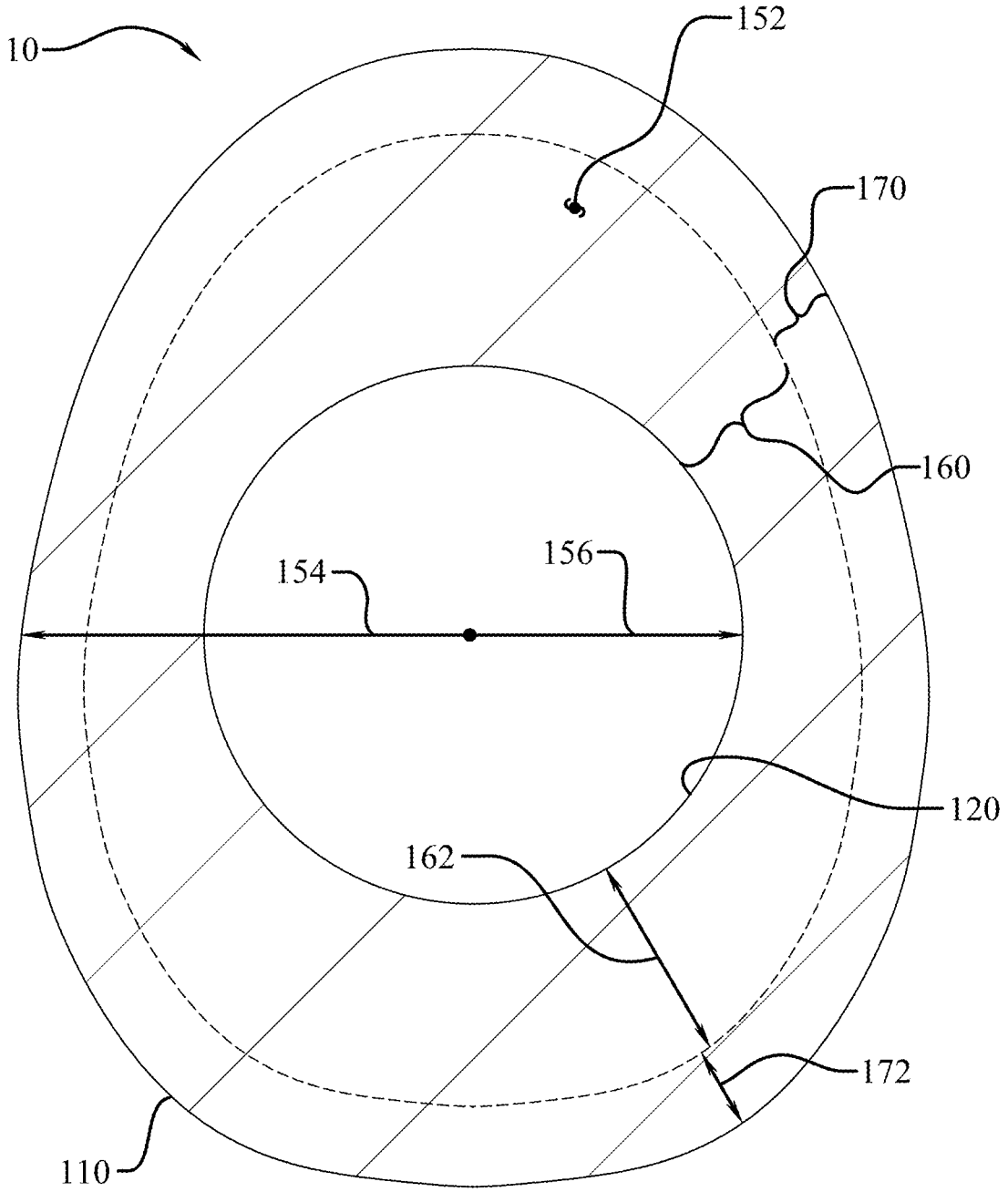
FIG. 5 shows a transverse cross-section, taken along section line 5-5 in FIG. 3, of an embodiment of the golf grip, not to scale.

As seen in FIG. 5, each point along the length of the golf grip (10) has a cross-section (150) characterized by a point specific cross-sectional area (152) and cross-sectional radius (154). In one embodiment specifically directed to a putter grip, at least one point along the length of the golf grip (10) has a cross-sectional area (152) of at least 4.75 $cm^2$, while in a further embodiment at least 50% of the length of the golf grip (10) has a cross-sectional area (152) of at least 4.75 $cm^2$. Still further, one embodiment has 85% of the length of the golf grip (10) has a cross-sectional area (152) of at least 4.75 $cm^2$. The cross-sectional radius (154) is the radius from the center of the central opening in the golf grip (10) to the exterior surface (110). In one embodiment specifically directed to a putter grip, at least one point along the length of the golf grip (10) has a cross-sectional radius (154) of at least 0.46 in, while in a further embodiment at least 50% of the length of the golf grip (10) has a cross-sectional radius (154) of at least 0.46 in. Still further, one embodiment has 85% of the length of the golf grip (10) has a cross-sectional radius (154) of at least 0.46 in. In a further embodiment, at least one point along the length of the golf grip (10) has a cross-sectional radius (154) of at least 0.525 in, while in a further embodiment at least 50% of the length of the golf grip (10) has a cross-sectional radius (154) of at least 0.525 in. Still further, one embodiment has 85% of the length of the golf grip (10) has a cross-sectional radius (154) of at least 0.525 in. In a further relatively non-tapered embodiment at least 50% of the length of the golf grip (10) has a cross-sectional radius (154) of 0.46-0.60 in; while in another embodiment at least 85% of the length of the golf grip (10) has a cross-sectional radius (154) of 0.46-0.60 in.

Figure 6:
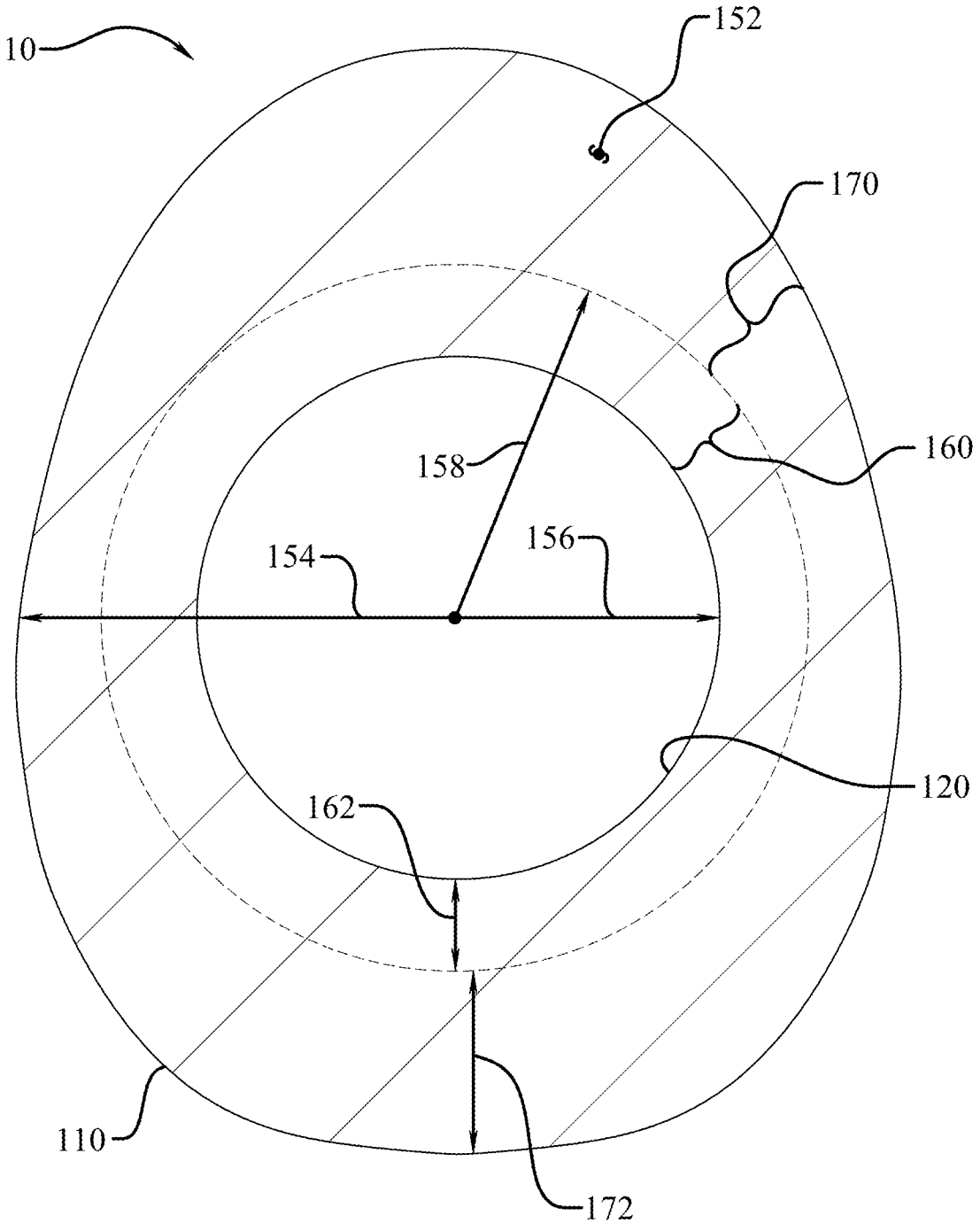
FIG. 6 shows a transverse cross-section, taken along section line 5-5 in FIG. 3, of an embodiment of the golf grip, not to scale.

A further oversized putter grip embodiment has at least one point along the length of the golf grip (10) has a cross-sectional area (152) of at least 6.75 $cm^2$, while in a further embodiment at least 50% of the length of the golf grip (10) has a cross-sectional area (152) of at least 6.75 $cm^2$. Still further, one embodiment has 85% of the length of the golf grip (10) has a cross-sectional area (152) of at least 6.75 $cm^2$. In one embodiment specifically directed to an oversized putter grip, at least one point along the length of the golf grip (10) has a cross-sectional radius (154) of at least 0.55 in, while in a further embodiment at least 50% of the length of the golf grip (10) has a cross-sectional radius (154) of at least 0.55 in. Still further, one embodiment has 85% of the length of the golf grip (10) has a cross-sectional radius (154) of at least 0.55 in. In a further relatively non-tapered embodiment at least 50% of the length of the golf grip (10) has a cross-sectional radius (154) of 0.55-0.70 in; while in another embodiment at least 85% of the length of the golf grip (10) has a cross-sectional radius (154) of 0.55-0.70 in. 35. Further, in another embodiment at least one point on the exterior surface (110) has a cross-sectional radius (154) of at least 0.65 inches. Additionally, another putter grip embodiment has a volume of at least 100 cc and a weight of 50-115 grams, while a further embodiment has a volume of 100-130 cc and a weight of 55-90 grams, while a further embodiment has a volume of at least 135 cc and a weight of 70-140 grams, and an even further embodiment has a volume of 135-160 cc and a weight of 75-100 grams, For the purpose of explaining multiple embodiments of the present invention a density gradient analysis procedure must be defined. First, as seen in FIGS. 5 and 6, a cross-section of the grip (10) reveals at least two regions; namely a first region (160) extending radially outward from the interior surface (120), and a second region (170) extending radially inward from the exterior surface (110). The first region (160) has a first region thickness (162) and a first region density; likewise the second region (170) has a second region thickness (172) and a second region density. For the purposes of this two region embodiment the boundaries of the regions are defined using the minimum cross-sectional radius (154) to the exterior surface (110), and the minimum interior surface radius (156) to the interior surface (120), for a particular cross-section taken at any point along the length of the golf grip (10). The radii are measured from the center of the hollow void in the middle of the golf grip (10) designed to receive the shaft (S), or from the centroid of the void if it is non-circular. Thus, for the sections shown in FIGS. 5 and 6, the minimum cross-sectional radius (154) to the exterior surface (110), and the minimum interior surface radius (156) to the interior surface (120), occur at the sides of the golf grip (10), however this procedure anticipates other shapes and other locations of these minimum radii. Once the minimum radii are determined, the difference is calculated and one-half of the difference is added to the minimum interior surface radius (156) to establish a first transition radius (158).

In one series of embodiments, one-third the difference between the minimum cross-sectional radius (154) and the minimum interior surface radius (156) is used establish a second region thickness (172), or an innermost boundary of the second region (170), as seen in FIG. 5, and by default establishes the first region (160) as well. Here, the second region (170) has a constant second region thickness (172) extending inward from the exterior surface (110), while the first region (160) may have a variable first region thickness (162). In one embodiment the variable first region thickness (162) has a maximum first region thickness (162) that is at least 25% greater than a minimum first region thickness (162); while in a further embodiment the maximum first region thickness (162) that is at least 50% greater than the minimum first region thickness (162).

Alternatively, in a second series of embodiments the first transition radius is used establish an outermost boundary of the first region (160), as seen in FIG. 6, and by default establishes the second region (170) as well. Here, the first region (160) has a constant first region thickness (162) extending outward from the interior surface (120), while the second region (170) may have a variable second region thickness (172).

One skilled in the art will appreciate that these procedures of establishing the first region (160) and the second region (170) are necessary because the final manufactured grip may not have a perceivable boundary between the two regions.

Further, while the disclosed regions and the disclosed relationships need only be present for a single cross-section taken at any point along the length of the golf grip (10), in further embodiment the disclosed relationships are present over at least 25% of the length of the golf grip (10), while an even further embodiment possesses the relationships over at least 50% of the length of the golf grip (10), and yet another embodiment possesses the relationships over at least 75% of the length of the golf grip (10).

Referring to the two region embodiments of FIGS. 5 and 6, in one embodiment the first region (160) has a first region average density, and the second region (170) has a second region average density. In this embodiment the first region average density is less than the second region average density; while in a further embodiment the first region average density is less than 75% of the second region average density; and in yet another embodiment the first region average density is less than 50% of the second region average density. In a further embodiment the density of the first region (160) varies radially at points extending outward from the center of the golf grip (10) producing a first region (160) with a point of higher density and a point of lower density, wherein the first region higher density is at least 10% greater than the first region lower density. In a further embodiment the first region higher density is at least 25% greater than the first region lower density, while in an even further embodiment the first region higher density is at least 50% greater than the first region lower density.

In one embodiment the average density of the second region (170) is at least twice the first region lower density, while in an even further embodiment the average density of the second region (170) is at least 2.5 times the first region lower density. The density variation within the golf grip (10) has been shown in improve the transmission of vibration from the shaft (S) to the exterior surface (110) of the golf grip (10). Another embodiment improves the durability of the golf grip (10), particularly during installation on a shaft (S), by having the first region higher density nearer to the interior surface (120), and the first region lower density nearer to the exterior surface (110). Thus, this embodiment has a density gradient that varies radially such that the first region lower density has a point inward toward the interior surface (120) possessing a first region higher density, which is greater than the first region lower density, as well as a point outward toward the exterior surface (110) that has a second region primary density, which is greater than the first region lower density. In one particularly durable embodiment the first region higher density is at least 20% greater than the first region lower density, while in an even further embodiment the first region higher density is at least 50% greater than the first region lower density.

Figure 10:
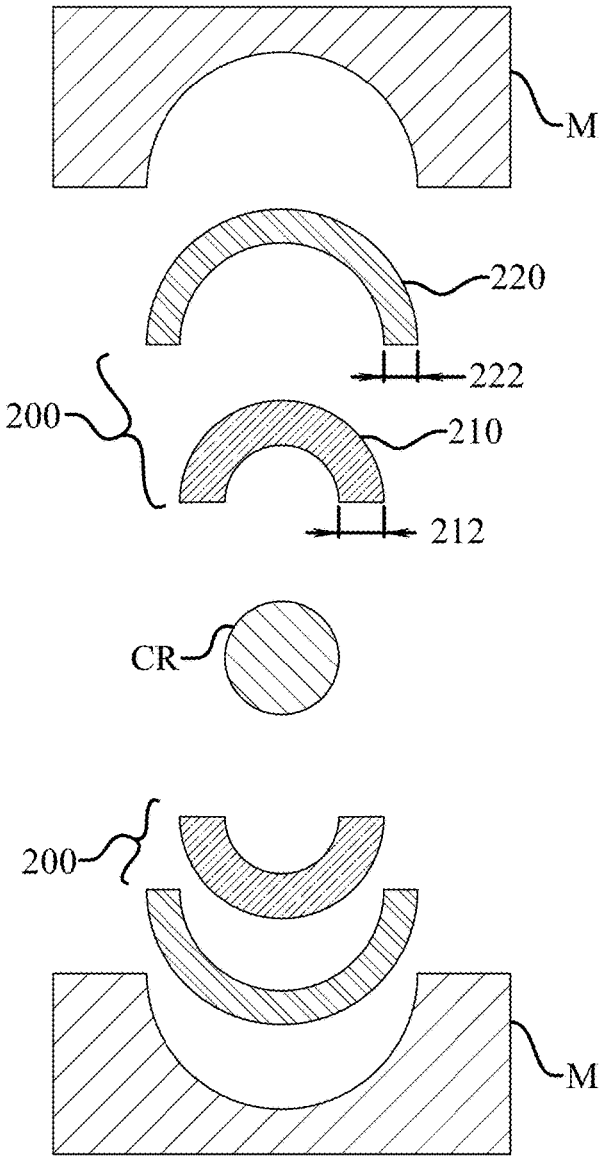
FIG. 10 shows a schematic cross-sectional assembly view of some components of an embodiment of the golf grip, not to scale.

A further embodiment enhances the transmission of vibration by tailoring the radial density gradient such that within a cross-section the density differential, between any two radial locations separated by a distance of 3 mm, is less than 0.25 g/cc; while in an even further embodiment the density differential between these two points is less than 0.15 g/cc; and a still further embodiment has the density differential between these two points of less than 0.10 g/cc. Thus, even though the golf grip (10) may be formed of a plurality of layers (200), including at least a first layer (210) and a second layer (220), as seen in FIG. 10, the materials are carefully selected and the manufacturing process is such that large density differentials are avoided. Further, as with all the disclosed relationships referencing a single cross-section of the golf grip (10), the described density differential need only be present for a single cross-section taken at any point along the length of the golf grip (10), however in further embodiment the disclosed relationships are present over at least 25% of the length of the golf grip (10), while an even further embodiment possesses the relationships over at least 50% of the length of the golf grip (10), and yet another embodiment possesses the relationships over at least 75% of the length of the golf grip (10).

In the density differential embodiments the density at a given radial point of analysis is determined first taking a cross-section of the grip so that the plane passes through the analysis point. Then, with the grip now cut into two portions, the longer portion is used and a second transverse cut is made through this portion at a distance of 1 cm from the first cut, thereby leaving a 1 cm long cross-sectional piece of the golf grip (10). Then, a point 1.5 mm radially outward, toward the exterior surface (110), from the analysis point is identified and a point 1.5 mm radially inward, toward the interior surface (120), from the analysis point is identified. A first circle is created, centered at the center of the shaft opening in the cross-sectional piece, that passes through the 1.5 mm radially outward point; and a second circle is created, centered at the center of the shaft opening in the cross-sectional piece, that passes through the 1.5 mm radially inward point. The 1 cm long cross-sectional piece is then ground, buffed, or cut to the first circle and the second circle, thereby creating a 1 cm thick and 3 mm wide ring centered about the analysis point. The weight and volume of this ring is measured to determine the density for the analysis point. This same procedure may be used to determine any density referenced to a particular point within the golf grip (10), as well as when determining the first region average density, the first region higher density, the first region lower density, and the second region average density.

In one embodiment the second region average density is at least 50% greater than the first region average density; while in a further embodiment the second region average density is at least 75% greater than the first region average density; and in an even further embodiment the second region average density is at least 100% greater than the first region average density. In another embodiment the second region average density is no more than 300% greater than the first region average density; while in a further embodiment the second region average density is no more than 200% greater than the first region average density; and in an even further embodiment the second region average density is no more than 100% greater than the first region average density. In one particular embodiment the second region average density is at least 0.8 g/cc, whereas in a further embodiment the second region average density is 0.85-1.1 g/cc. In another embodiment the first region average density is less than 0.6 g/cc, whereas in a further embodiment the first region average density is 0.3-0.5 g/cc. In still a further embodiment the first region higher density is at least 0.6 g/cc, whereas in a further embodiment the first region higher density is less than 0.9 g/cc. In addition to the vibration transmission afforded by the second region (170), the higher second region average density also improves the wear resistance, UV resistance, and tactile feel of the golf grip (10).

In one embodiment the overall density of the entire golf grip (10) is 0.45-0.65 g/cc, while in a further embodiment the overall density of the entire golf grip (10) is 0.50-0.60 g/cc, and in an even further embodiment the overall density of the entire golf grip (10) is 0.53-0.58 g/cc. In one particular embodiment the first region lower density is less than 70% of the overall density of the entire golf grip (10), and the second region average density is at least 65% greater than the overall density of the entire golf grip (10). Yet in a further embodiment the first region lower density is 40-65% of the overall density of the entire golf grip (10), and the second region average density is 70-90% greater than the overall density of the entire golf grip (10). In an alternative series of embodiments the overall density of the entire golf grip (10) is 0.70-1.00 g/cc, while in a further embodiment the overall density of the entire golf grip (10) is 0.75-0.95 g/cc, and in an even further embodiment the overall density of the entire golf grip (10) is 0.80-0.90 g/cc.

Figure 7:
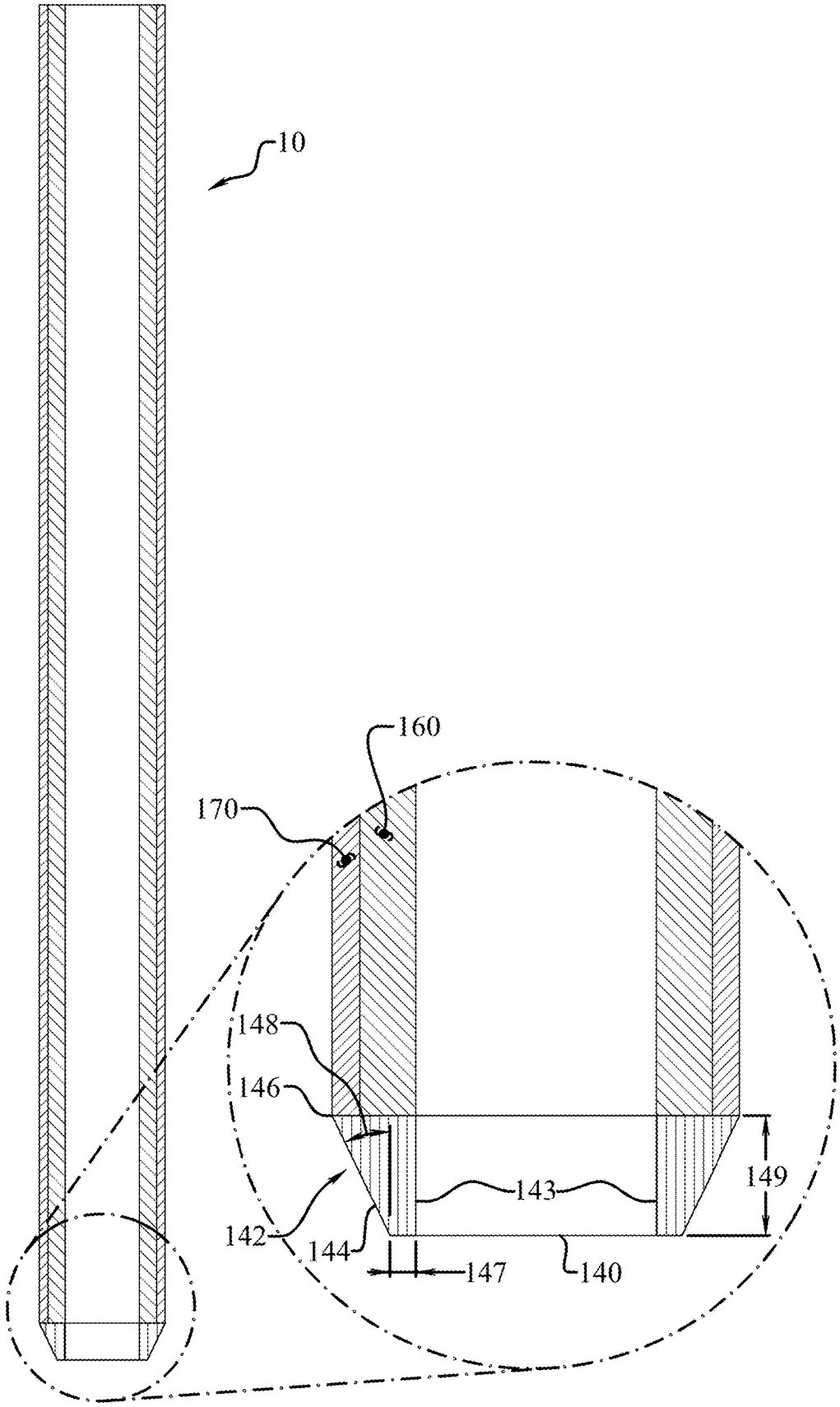
FIG. 7 shows a longitudinal cross-section, taken along section line 7-7 in FIG. 2, of an embodiment of the golf grip, not to scale.

With reference to FIG. 7, in another embodiment the transmission of vibration from the shaft (S) to the exterior surface (110) is furthered by the incorporation of a tip-to-shaft connector (142) at the tip end (140) of the golf grip (10). The tip-to-shaft connector (142) has a connector density, and in one embodiment the average connector density is at least as great as the second region average density. The tip-to-shaft connector (142) has a connector interior surface (143), a connector exterior surface (144), a connector proximal end (146), a portion of which is in contact with a portion of the second region (170), and a connector distal end (145) having a connector distal end thickness (147). In a further embodiment a portion of the connector proximal end (146) is in contact with the exterior surface (110), while in an even further embodiment a portion of the tip-to-shaft connector (142) is also in contact with the first region (160). At least a portion of the connector interior surface (143) is sized so that it is the same size and configuration as the interior surface (120), or smaller, thereby ensuring that a portion of the connector interior surface (143) is in contact with the shaft (S) and can promote the transmission of vibrations from the shaft (S) to the exterior surface (110). In fact, in one embodiment the tip-to-shaft connector (142) has a connector length (149) that is at least 0.125" and at least 50% of the connector length (149) is configured so that the connector interior surface (143) is in contact with the shaft (S) to further promote the transmission of vibrations. Further, in another embodiment the connector distal end thickness (147) is at least 0.0625", also further enhancing vibration transmission. While in another embodiment the connector exterior surface (144) transitions from the connector distal end (145) to the size of the golf grip (10) at connector angle (148), and in one embodiment the connector angle (148) is at least 15 degrees and less than 75 degrees, thereby eliminating transmission losses associated with hard corners. In one embodiment the tip-to-shaft connector (142) has a connector volume that is less than 10% of the total volume of the golf grip (10).

Figure 8:
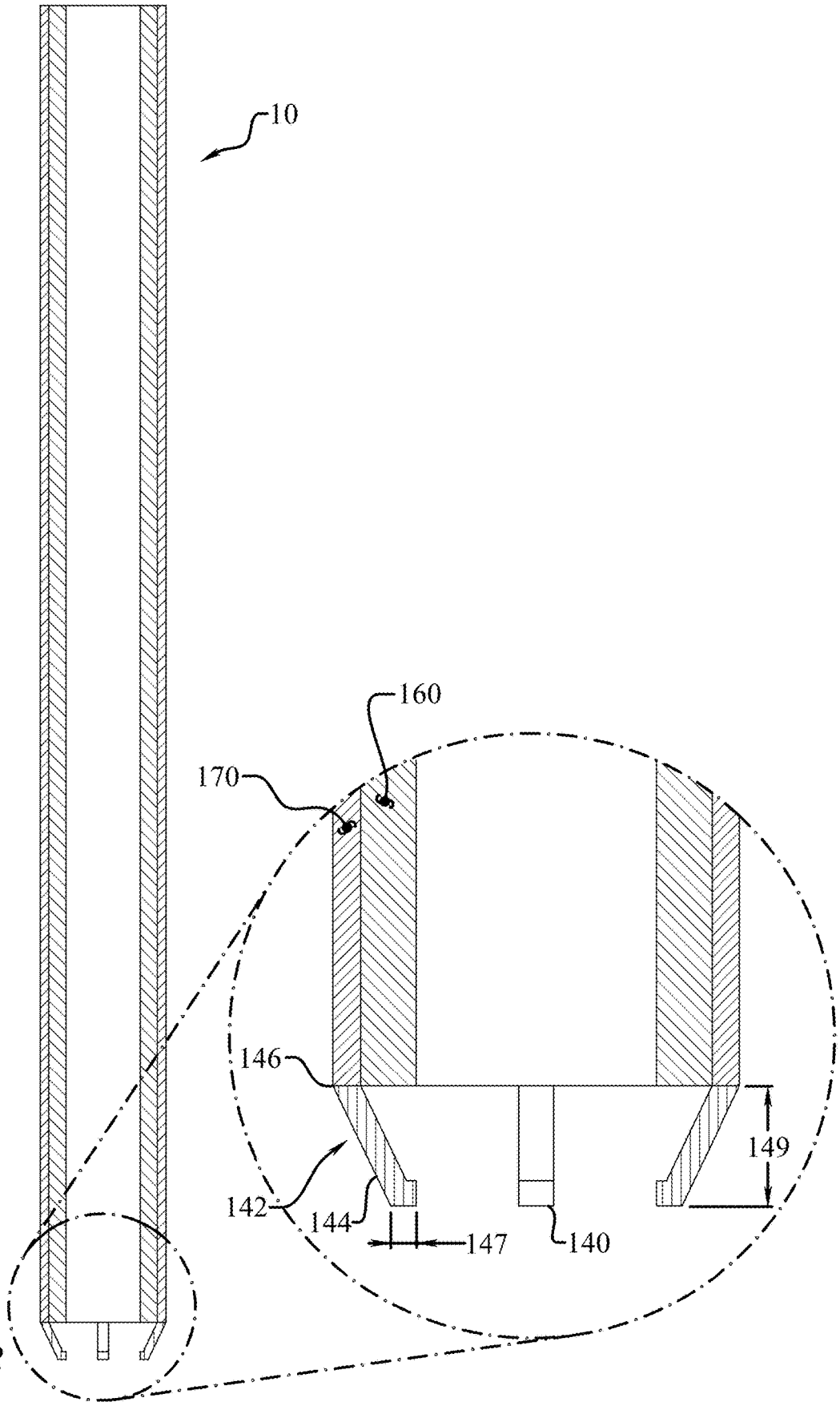
FIG. 8 shows a longitudinal cross-section, taken along section line 7-7 in FIG. 2, of an embodiment of the golf grip, not to scale.

In one embodiment the tip-to-shaft connector (142) is cured with the second region (170) in one step, so there is no obvious line of structural change. In an even further embodiment, the average density of the connector is within 20% of the second region average density. While the embodiment illustrated in FIG. 7 illustrates a solid tip-to-shaft connector (142), the tip-to-shaft connector (142) may consist of a plurality of fingers, seen in FIG. 8, having a portion of connector distal end (145) in contact with the shaft (S) and a portion of the connector proximal end (146) is in contact with the exterior surface (110).

Figure 9:
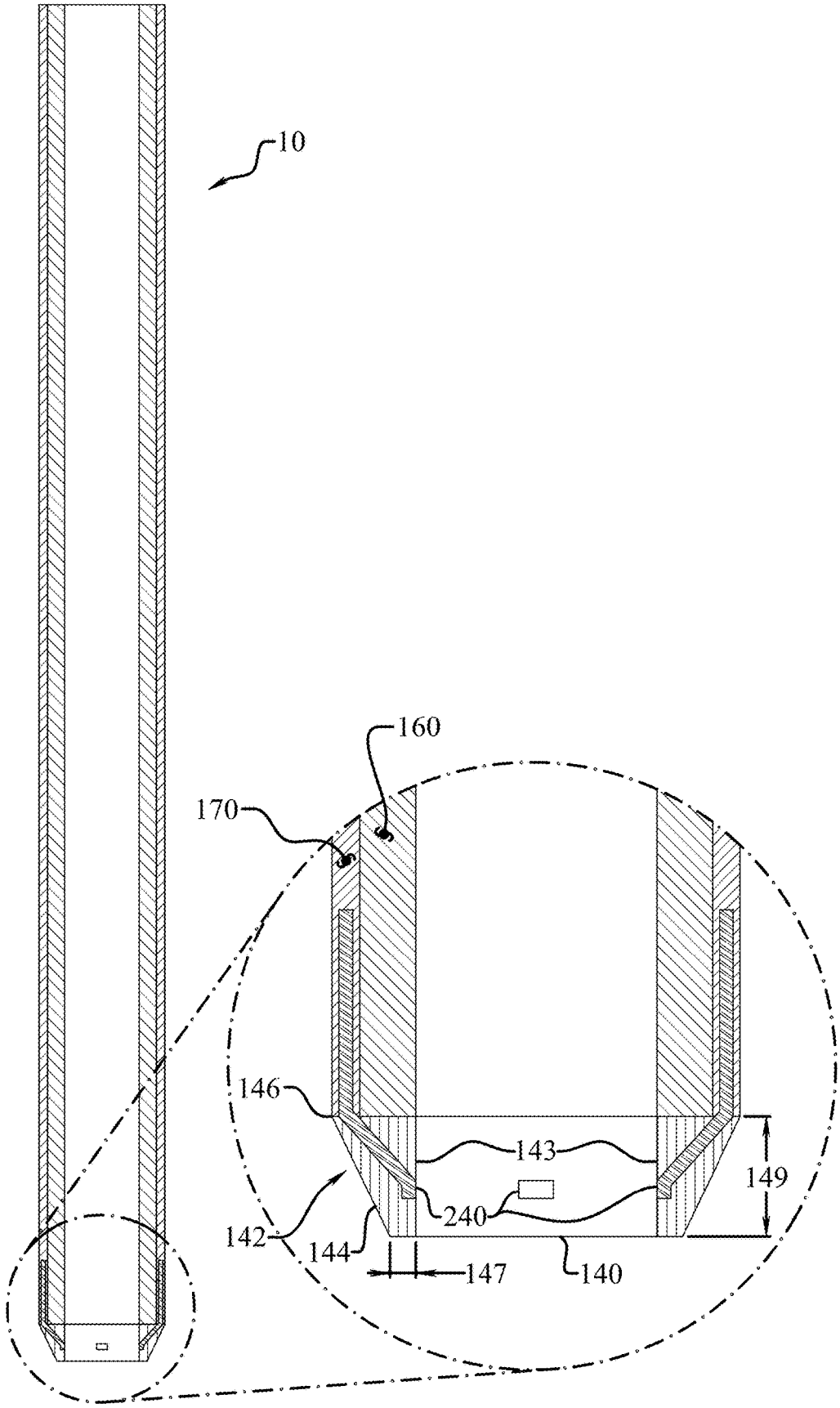
FIG. 9 shows a longitudinal cross-section, taken along section line 7-7 in FIG. 2, of an embodiment of the golf grip, not to scale.

Still further, as seen in FIG. 9, the golf grip (10) may include a transmission enhancement structure (240). A portion of the transmission enhancement structure (240) is in contact with the second region (170) and a portion of the transmission enhancement structure (240) is in contact with the interior surface (120), so that it will be in contact with the shaft (S) and can further promote the transmission of vibration to the second region (170). In one embodiment the transmission enhancement structure (240) has an average density that is at least as great as the second region average density. In one embodiment the average density of the transmission enhancement structure (240) is at least 10% greater than the second region average density. While in another embodiment, illustrated in FIG. 9, a portion of the transmission enhancement structure (240) extends through the tip-to-shaft connector (142).

In a further embodiment the transmission enhancement structure (240) simply passes from the second region (170) through the first region (160) to the interior surface (120); thus this embodiment need not incorporate a tip-to-shaft connector (142). In fact, in one embodiment the transmission enhancement structure (240) is similar to the tip-to-shaft connector (142) but is shifted toward the butt end (130). In one such embodiment the transmission enhancement structure (240) is a ring of material that extends from the interior surface (120) to the second region (170), and has a density that is at least as great as the second region average density. In a further embodiment designed to have minimal impact on the overall density of the golf grip (10), the volume of the transmission enhancement structure (240) is less than 10% of the volume of the golf grip (10). Yet a further embodiment includes at least two such rings spaced apart by at least 3 inches along the length of the golf grip (10) so that one hand of the golfer is in contact with the exterior surface (110) over the location of the ring. Even further, these at least two such rings may extend all the way to the exterior surface and be visible to the user.

Referring back to non-ring type embodiments of the transmission enhancement structure (240), in yet a further embodiment the longitudinal strip-like transmission enhancement structure (240) extends a distance longitudinally along the axis of the golf grip (10) that is at least 10% of the distance from the tip end (140) to the butt end (130), while in further embodiments it extends at least 25%, at least 50%, or at least 75% of the distance from the tip end (140) to the butt end (130). While in these embodiments the transmission enhancement structure (240) extends longitudinally a specified distance, it need not extend in a straight line.

The transmission enhancement structure (240) may be a thin strip, a wire, or a layer, composed of material having good vibration transmission properties. In one embodiment the transmission enhancement structure (240) is formed with the golf grip (10) in a compression molding process. Further, in another embodiment a portion of the transmission enhancement structure (240) is a part of the exterior surface (110) of the golf grip (10) so that it is visible along the exterior surface (110). In yet another embodiment the transmission enhancement structure (240) has a density that is at least twice the second region average density; while in another embodiment the transmission enhancement structure (240) is composed of a metallic alloy, which in some embodiments is selected from the group of aluminum, steel, titanium, copper, bronze, brass, magnesium, and nickel. Thus, in one embodiment the density of the transmission enhancement structure (240) is at least 50% greater than the second region average density; and in a further embodiment the density of the transmission enhancement structure (240) is at least 100% greater than the second region average density.

Figure 11:
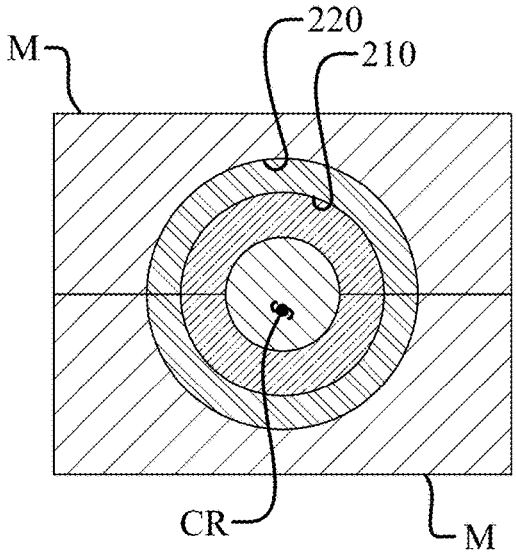
FIG. 11 shows a schematic cross-sectional assembly view of some components of an embodiment of the golf grip, not to scale.

As previously touched upon, in one embodiment the golf grip (10) may be formed of a plurality of layers (200), including at least a first layer (210) and a second layer (220), as seen in FIGS. 10 and 11. The individual layers may be adhered to each other, or joined in a compression molding process. In one such embodiment the first layer (210) has a first layer thickness (212) and the second layer (220) has a second layer thickness (222), both being thicknesses measured before the actual manufacturing process, thus an uncured thickness. A further embodiment has a first layer thickness (212) that is at least 25% greater than a second layer thickness (222). In one embodiment the first layer thickness (212) is 1.50-3.00 mm and the second layer thickness (222) is 1.25-2.50 mm; while in a further embodiment the first layer thickness (212) is 2.00-2.80 mm and the second layer thickness (222) is 1.70-2.25 mm; and in yet another embodiment the first layer thickness (212) is 2.30-2.70 mm and the second layer thickness (222) is 1.80-2.00 mm.

Further, the first layer (210) and the second layer (220) may contain different quantities of blowing agent causing them to expand differently during a compression molding curing process. For instance, in one example the first layer (210) has a quantity of blowing agent that is at least twice the quantity of blowing agent in the second layer (220); while in a further embodiment the first layer (210) has a quantity of blowing agent that is at least 2.5 times the quantity of blowing agent in the second layer (220); and in an even further embodiment the first layer (210) has a quantity of blowing agent that is at least 3 times the quantity of blowing agent in the second layer (220). The quantity of blowing agent is measure in parts per hundred rubber (phr). The blowing agents for expanding the compositions may include, but are not limited to, dinitrosopentamethylenetetramine (DPT), azodicarbonamide (AZC), p-toluenesulfonyl hydrazide (TSH), 4,4'-oxybisbenzenesulfonyl hydrazide (OBSH), and the like, and inorganic foaming agents, such as sodium hydrogen carbonate. Further, the blowing agent may include di-azo compounds which release N2 gas at high temperature, N2 gas introduced during the foaming process, CO2 from decompose chemical foaming agents, and/or expend-cell system having core-shells containing vaporization liquid inside, often referred to as expandable microspheres or microcapsules.

In one embodiment the first layer (210) and the second layer (220) are rubber compounds of either EPDM or a natural rubber and EPDM mixture. Further in one embodiment the first layer (210) has a high material hardness of at least 55 Shore A prior to compression molding, which then can support itself after expansion in the compression molding process. In one embodiment the first layer (210) has a very high ethylene content, a high molecular weight, a high filler content to improve hardness, which in one embodiment includes silicate, a high styrene content for hardness, a very high diene ratio EPDM for cross-linking, and a low oil content to improve the ability to maintain hardness. In a further embodiment the second layer (220) is selected to provide a relatively high hardness with good abrasion resistance by incorporating a high ethylene content, a high filler content to improve hardness and abrasion resistance, which in one embodiment includes treated silicate, a high diene ratio for cross-linking, and an average oil content for processability, feel, and abrasion resistance. The golf grip (10) does not have a separate underlisting and is felt-free.

Figure 12:
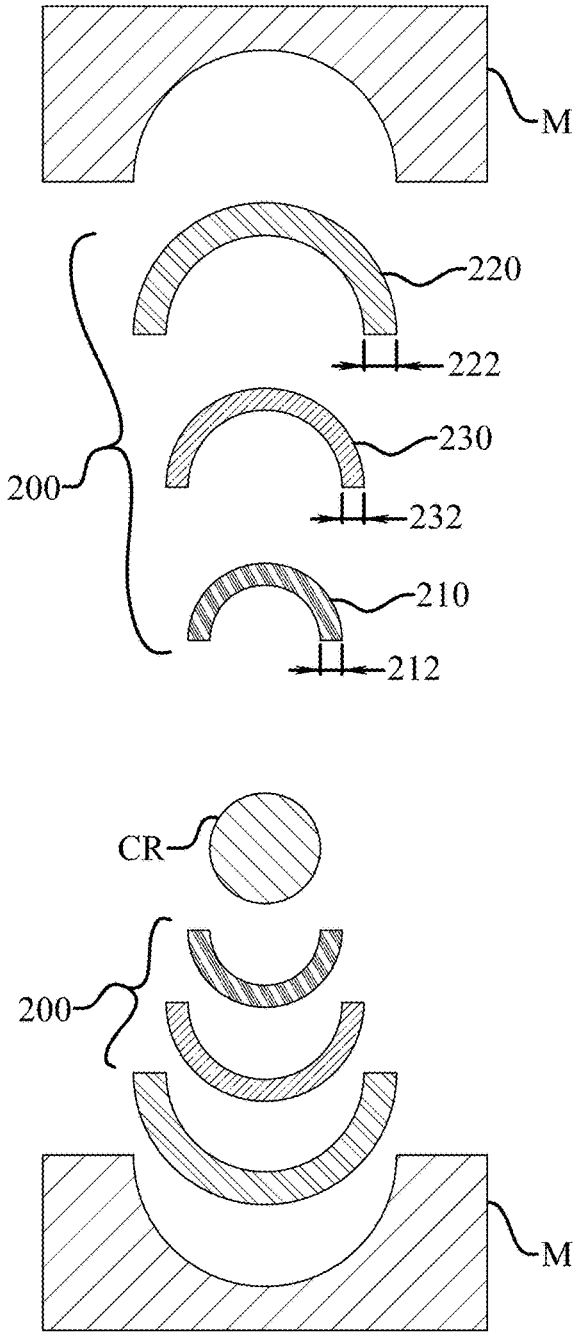
FIG. 12 shows a schematic cross-sectional assembly view of some components of an embodiment of the golf grip, not to scale.
Figure 13:
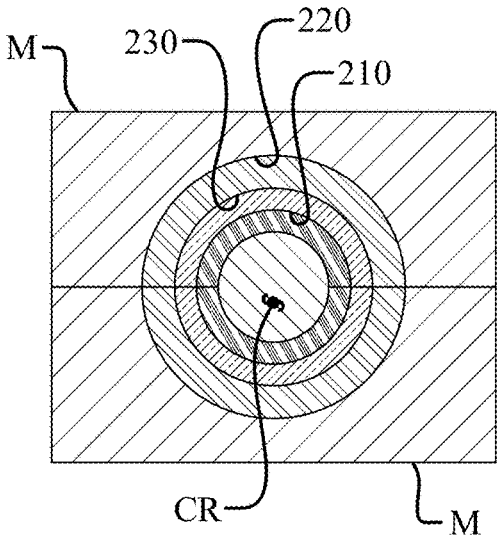
FIG. 13 shows a schematic cross-sectional assembly view of some components of an embodiment of the golf grip, not to scale.

In addition to the two layer embodiment just described, a further embodiment seen in FIGS. 12 and 13 includes a third layer (230), having a third layer thickness (232), located between the first layer (210) and the second layer (220). Including a third layer (230) may increase the precision of the manufacturing process. As with the two layer embodiments, the individual layers may be adhered to each other, or joined in a compression molding process. Again, the individual layer thicknesses discussed herein are measured before the actual manufacturing process, thus an uncured thickness. In one embodiment both the first layer thickness (212) and the third layer thickness (232) are less than the second layer thickness (222); in fact, in a further embodiment both the first layer thickness (212) and the third layer thickness (232) are at least 20% less than the second layer thickness (222). In an even further embodiment both the first layer thickness (212) and the third layer thickness (232) are at least 50-75% of the second layer thickness (222). In yet another embodiment the first layer thickness (212) and the third layer thickness (232) are 1.00-1.50 mm and the second layer thickness (222) is 1.25-2.50 mm; while in a further embodiment the first layer thickness (212) and the third layer thickness (232) are 1.25-1.40 mm and the second layer thickness (222) is 1.70-2.25 mm; and in yet another embodiment the first layer thickness (212) and the third layer thickness (232) are 1.30-1.35 mm and the second layer thickness (222) is 1.80-2.00 mm. In one embodiment the third layer (230) has a quantity of blowing agent that is at least twice the quantity of blowing agent in the second layer (220); while in a further embodiment the third layer (230) has a quantity of blowing agent that is at least 2.5 times the quantity of blowing agent in the second layer (220); and in an even further embodiment the third layer (230) has a quantity of blowing agent that is at least 3 times the quantity of blowing agent in the second layer (220).

In another embodiment both the first layer thickness (212) and the second layer thickness (222) are less than the third layer thickness (232); in fact, in a further embodiment both the first layer thickness (212) and the second layer thickness (222) are at least 20% less than the third layer thickness (232). In an even further embodiment both the first layer thickness (212) and the second layer thickness (222) less than half of the maximum third layer thickness (232). In yet another embodiment the first layer thickness (212) and the second layer thickness (222) are less than 1.50 mm and the third layer thickness (232) is at least 2.00 mm; while in a further embodiment the first layer thickness (212) is less than 20% of the maximum third layer thickness (232) and the first layer thickness (212) is less than 50% of the maximum second layer thickness (222). In an even further embodiment the first layer thickness (212) is less than 0.50 mm, the second layer thickness (222) is at least 0.75 mm, and the third layer thickness (232) is 1.5-8.0 mm.

Further, in these three layer embodiments the first layer (210), the second layer (220), and the third layer (230) may contain different quantities of blowing agent causing them to expand differently during a compression molding curing process. For instance, in one example the first layer (210) and the third layer (230) each have a quantity of blowing agent that is at least twice the quantity of blowing agent in the second layer (220); while in a further embodiment the first layer (210) and the third layer (23) each have a quantity of blowing agent that is at least 2.5 times the quantity of blowing agent in the second layer (220); while in an even further embodiment the first layer (210) and the third layer (230) each have a quantity of blowing agent that is at least 3 times the quantity of blowing agent in the second layer (220); while in yet an even further embodiment the first layer (210) and the third layer (230) each have a quantity of blowing agent that is 3-6 times the quantity of blowing agent in the second layer (220); and in an even further embodiment the first layer (210) and the third layer (230) each have a quantity of blowing agent that is 4-5.5 times the quantity of blowing agent in the second layer (220). The blowing agents previously discussed are also applicable to this third layer (230), as are the material compositions and characteristics of the first layer (210).

The quantity of blowing agent and the compression molding process parameters affect the density, porosity, and hardness of the regions of the golf grip (10). The golf grip (10) may be compression molded using the layers previously discussed. Strips of the layers are positioned in both halves of the compression mold (M), about a core rod (R), as shown in FIGS. 10-13 and 15-16, in an arrangement corresponding to that desired in the finished grip. A core rod (CR), or mandrel, is positioned in the half mold to facilitate forming the hollow tubular golf grip (10). The compression half molds are clamped together and heated to a temperature that vulcanizes and joins the layers together into the tubular form of the finished golf grip (10). In some embodiment the core rod (CR) is heated, or warmed, to a temperature of at least 120° C. to also promote curing from the interior surface (120) and produce the first region higher density toward the interior surface (120) of the golf grip (10); while in a further embodiment the core rod (CR) is heated, or warmed, to a temperature of at least 140° C.; and in an even further embodiment the core rod (CR) is heated, or warmed, to a temperature of at least 165° C.

Figure 14:
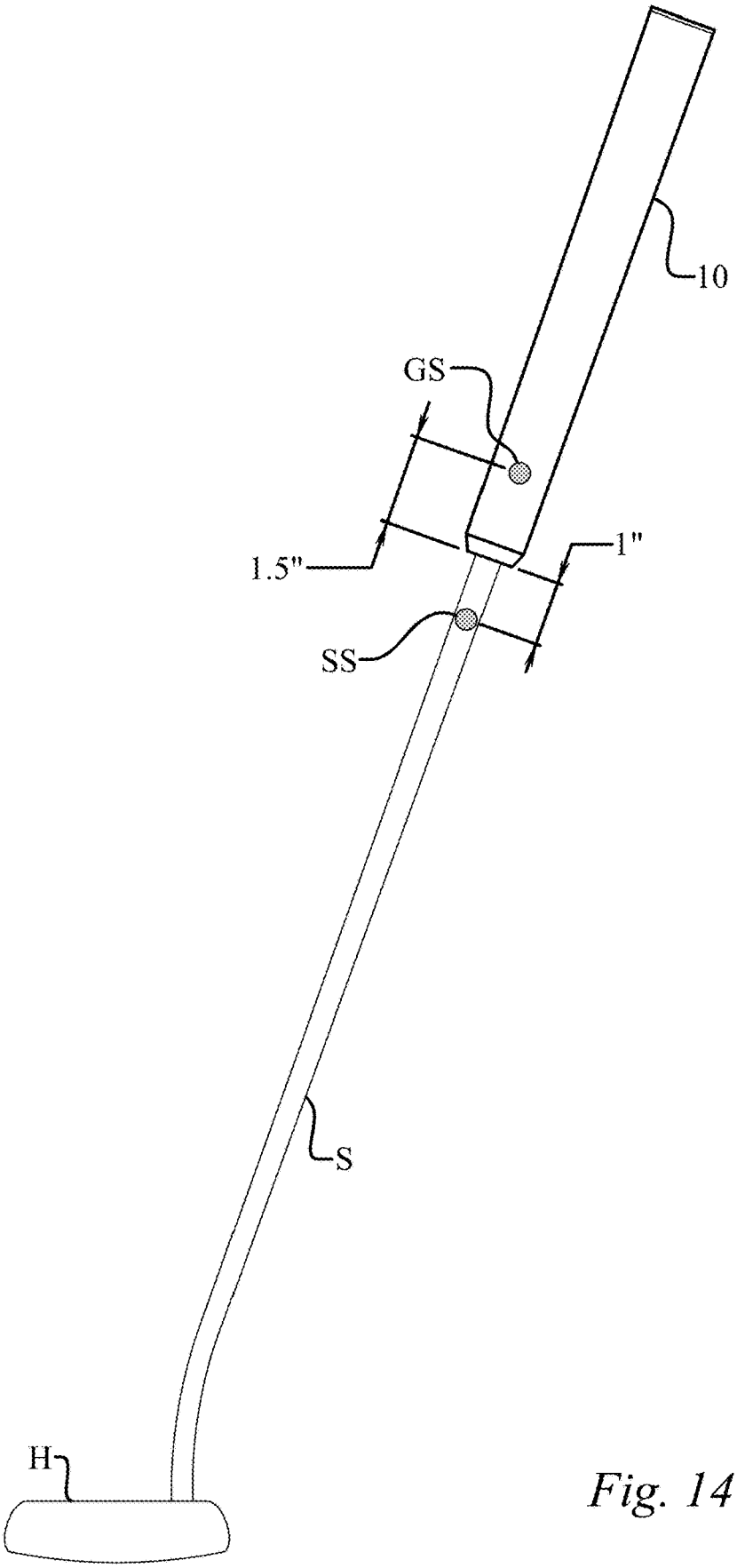
FIG. 14 shows a front elevation view of an embodiment of the golf grip installed on a golf club with sensor locations indicated, not to scale.
Figure 15:
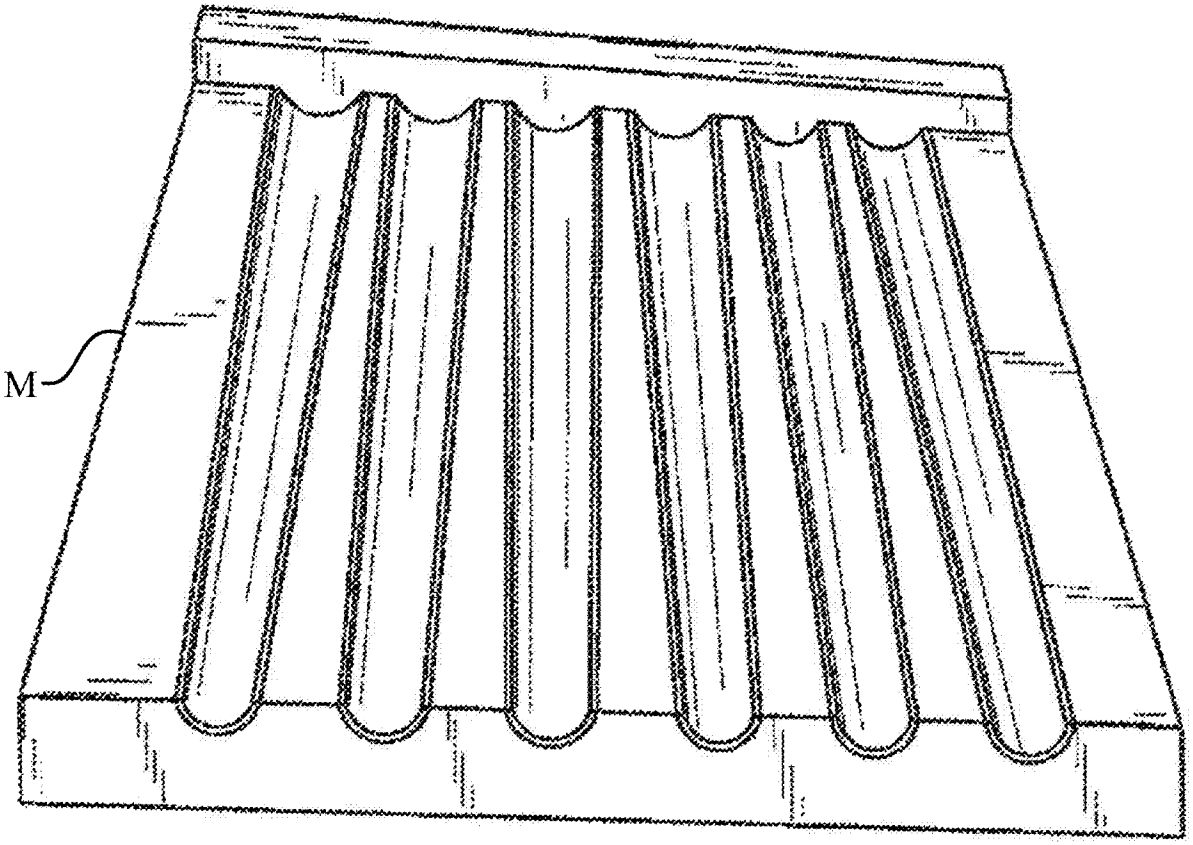
FIG. 15 shows a partial isometric view of compression molding equipment used to make an embodiment of the golf grip.
Figure 16:
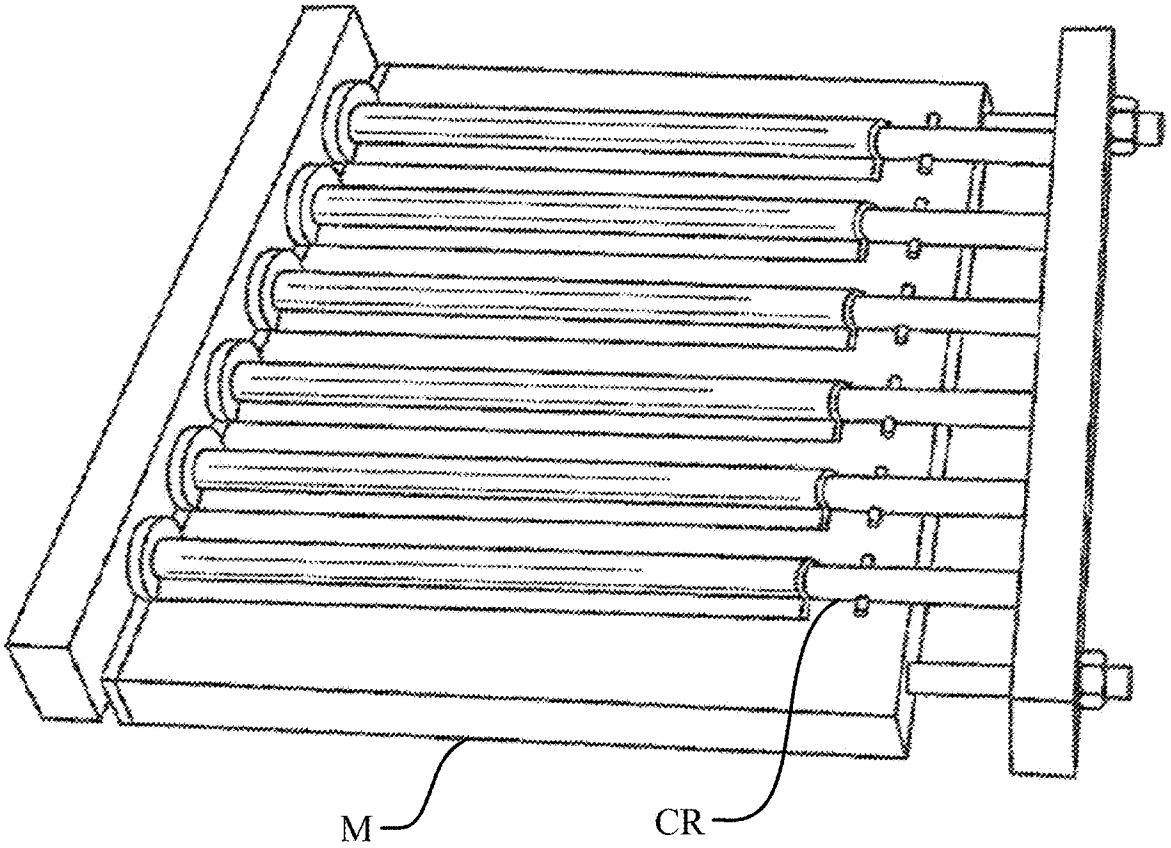
FIG. 16 shows a partial isometric view of compression molding equipment used to make an embodiment of the golf grip.

Testing of an embodiment of the present invention has shown enhanced transmission of vibrations compared to a competitor's product. Testing involved 10 testers that vary experience, from minimal golf activity to experienced golfers. The test consisted of putting a golf ball a distance between 10 feet and 12 feet distance. Identical putters were equipped with an embodiment of the present invention and a competitor's golf grip. The clubs were equipped with either an embodiment of the present invention, labeled "Present Embodiment" in FIGS. 17-26, or a competitor's product, labeled "Comp Example" in FIGS. 17-26. The vibration force response on the metal golf club shaft and on the grip held by the golfer was measured and recorded during a series of 10 putts using each type of grip. As seen in FIG. 14, a vibration sensor was installed on the side of the golf grip, namely a grip sensor (GS), at a location 1.5 inches from the tip end (140) toward the butt end (130); and a vibration sensor was installed on the side of the shaft (S), namely a shaft sensor (SS), at a location 1 inch from the tip end (140) toward the putter head (H). The sensors were 100 Mv/g accelerometers attached at the specified locations using high strength adhesive. The sensors were connected to an IO-tech Dynamic Signal Analyzer (multichannel) and laptop computer. The data was acquired using a ZonicBook dynamic signal analyzer.

Analysis of the data found that the 5 most experienced golfers, associated with FIGS. 17, 18, 19, 20, and 25, had less deviation in their stroke than other testers of FIGS. 21, 22, 23, 24, and 26. The average amplification of feel to the 5 experienced golfers' hands for the "Present Embodiment" grip is 49% higher than that of the "Comp Example" grip. Thus, the "Present Embodiment" grip provided 49% more energy to the grip sensor (GS) than was provided by the "Comp Example" grip, for the 5 most experienced golfers. Further, the average deviation in force, which can be thought of as the consistency of the putt, from golfer to golfer in the top 5 experienced golfers using the "Present Embodiment" grip is 28% less deviation than was recorded when the same testers used the "Comp Example" grip. This is an indication the golfers consistently had a better feel for the putts as they made the putting stroke.

Figure 17:
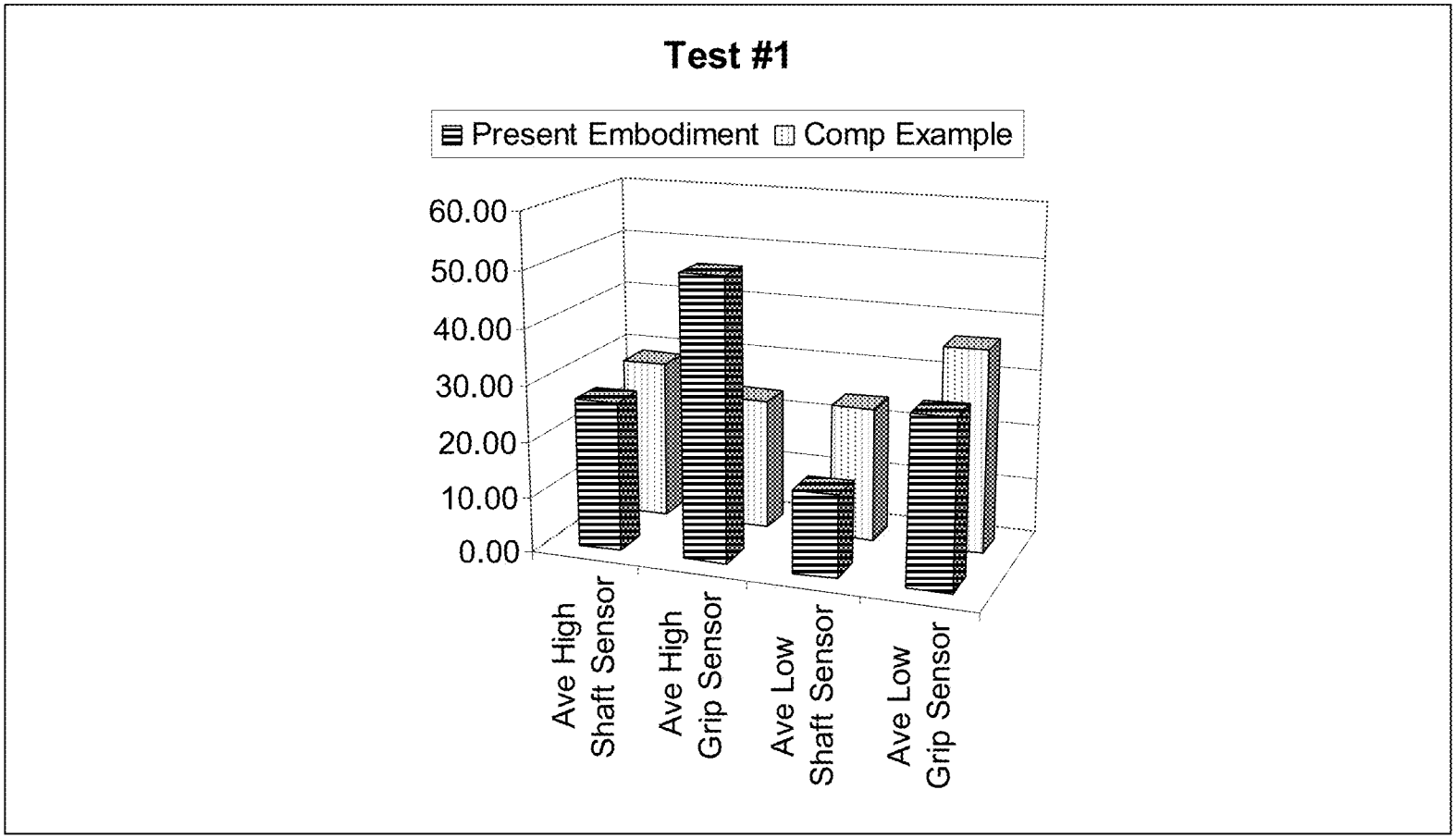
FIG. 17 shows test data associated with an embodiment of the present golf grip compared with that of a competitor's golf grip.
Figure 18:
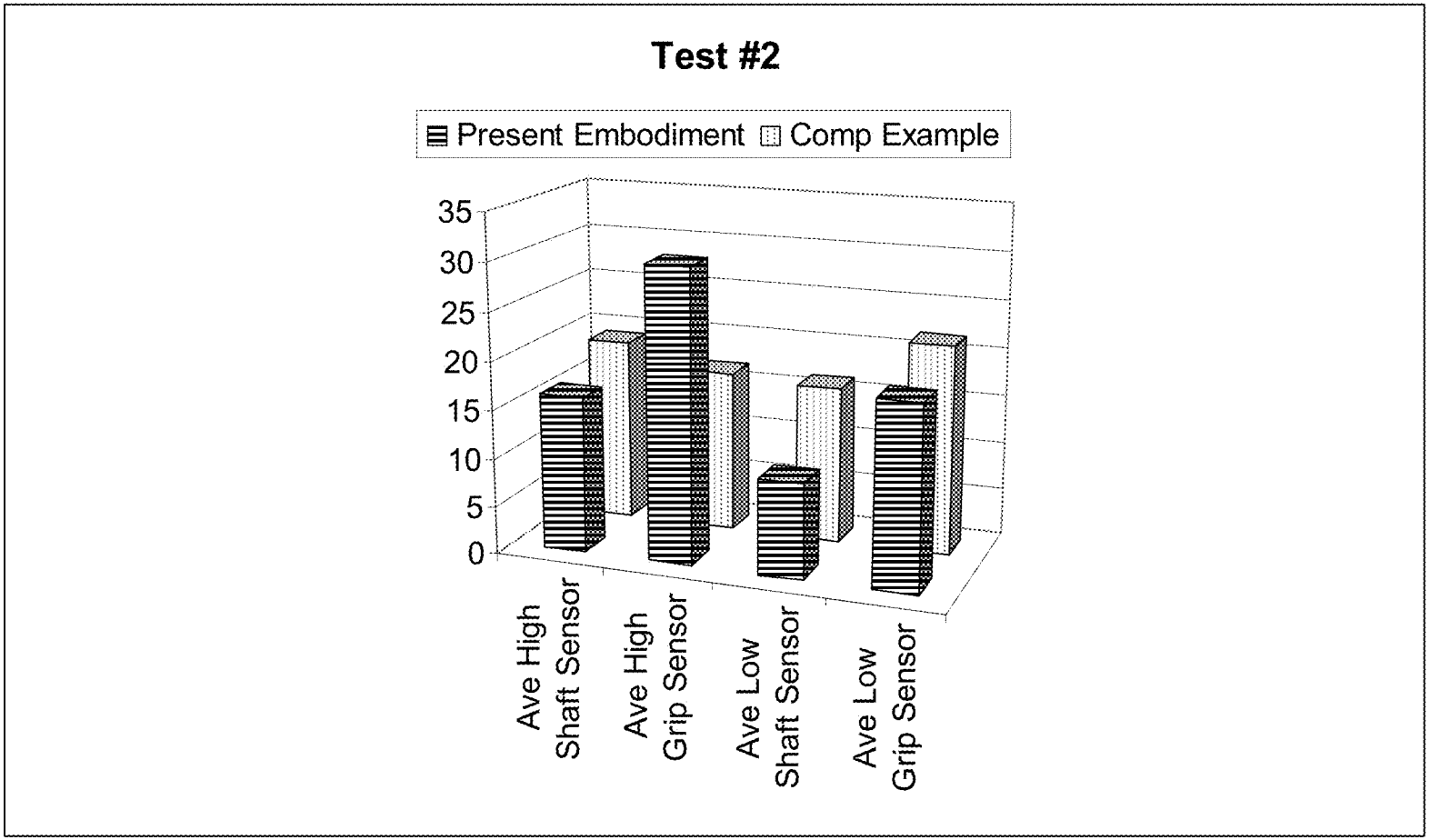
FIG. 18 shows test data associated with an embodiment of the present golf grip compared with that of a competitor's golf grip.
Figure 19:
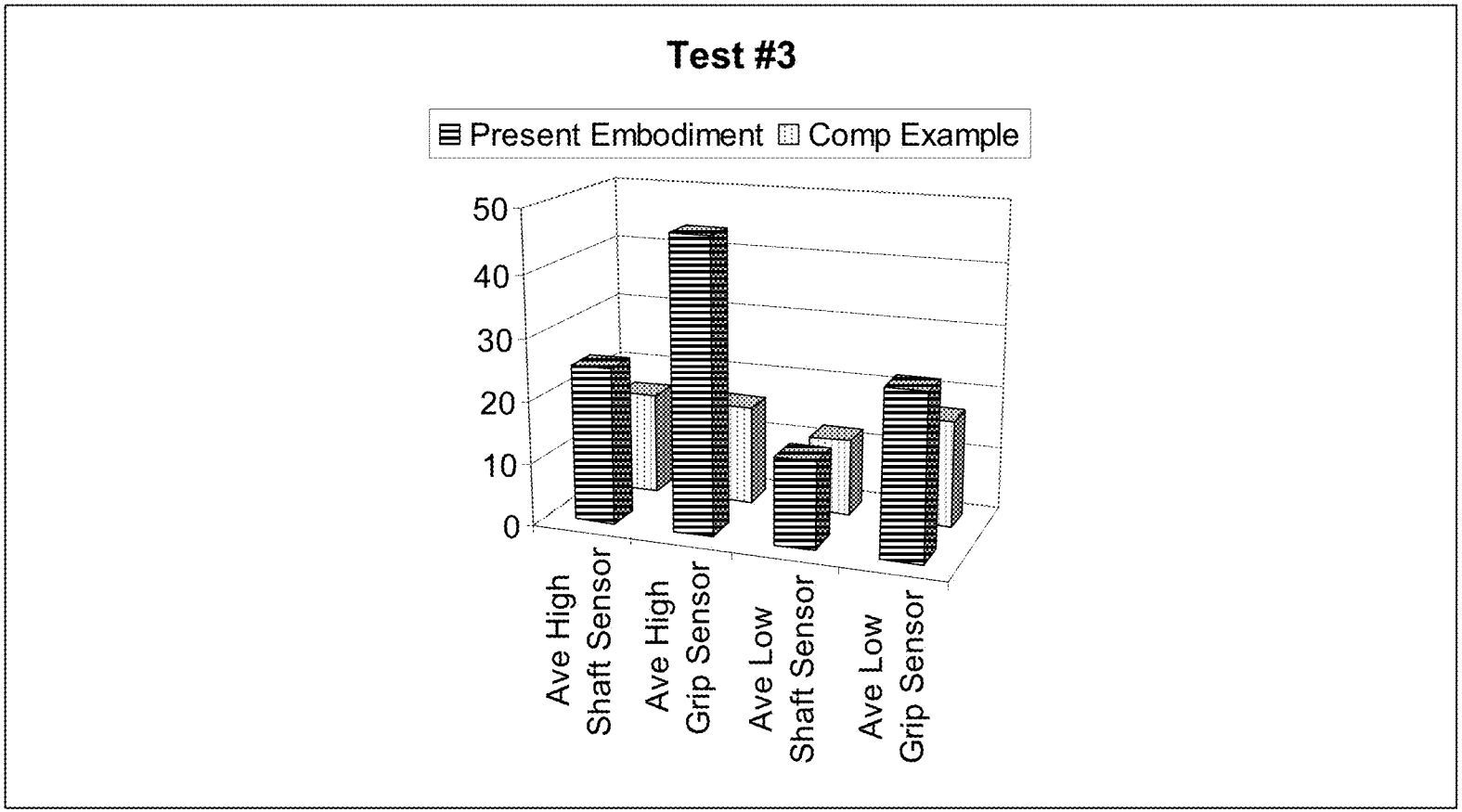
FIG. 19 shows test data associated with an embodiment of the present golf grip compared with that of a competitor's golf grip.
Figure 20:
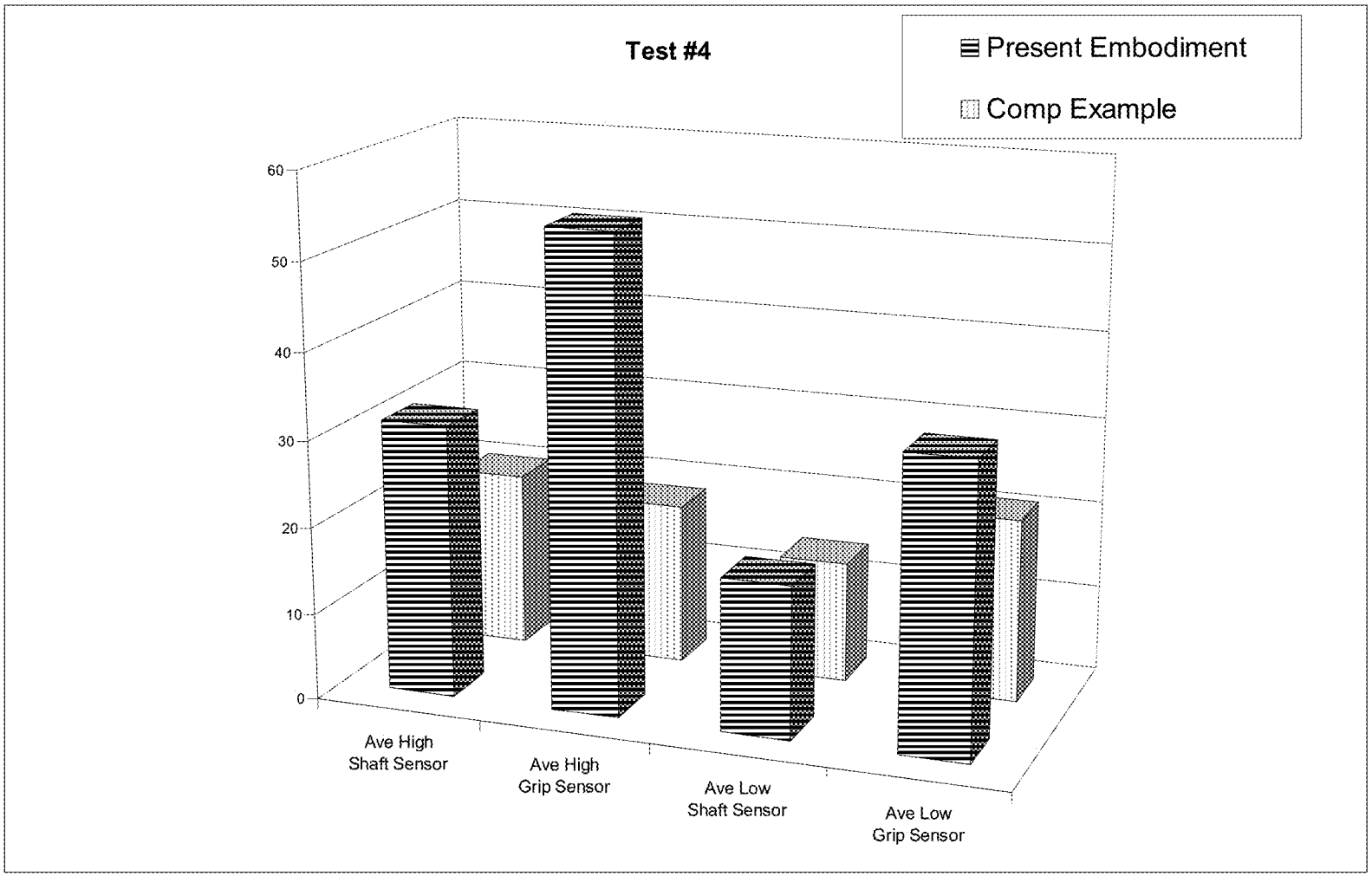
FIG. 20 shows test data associated with an embodiment of the present golf grip compared with that of a competitor's golf grip.
Figure 21:
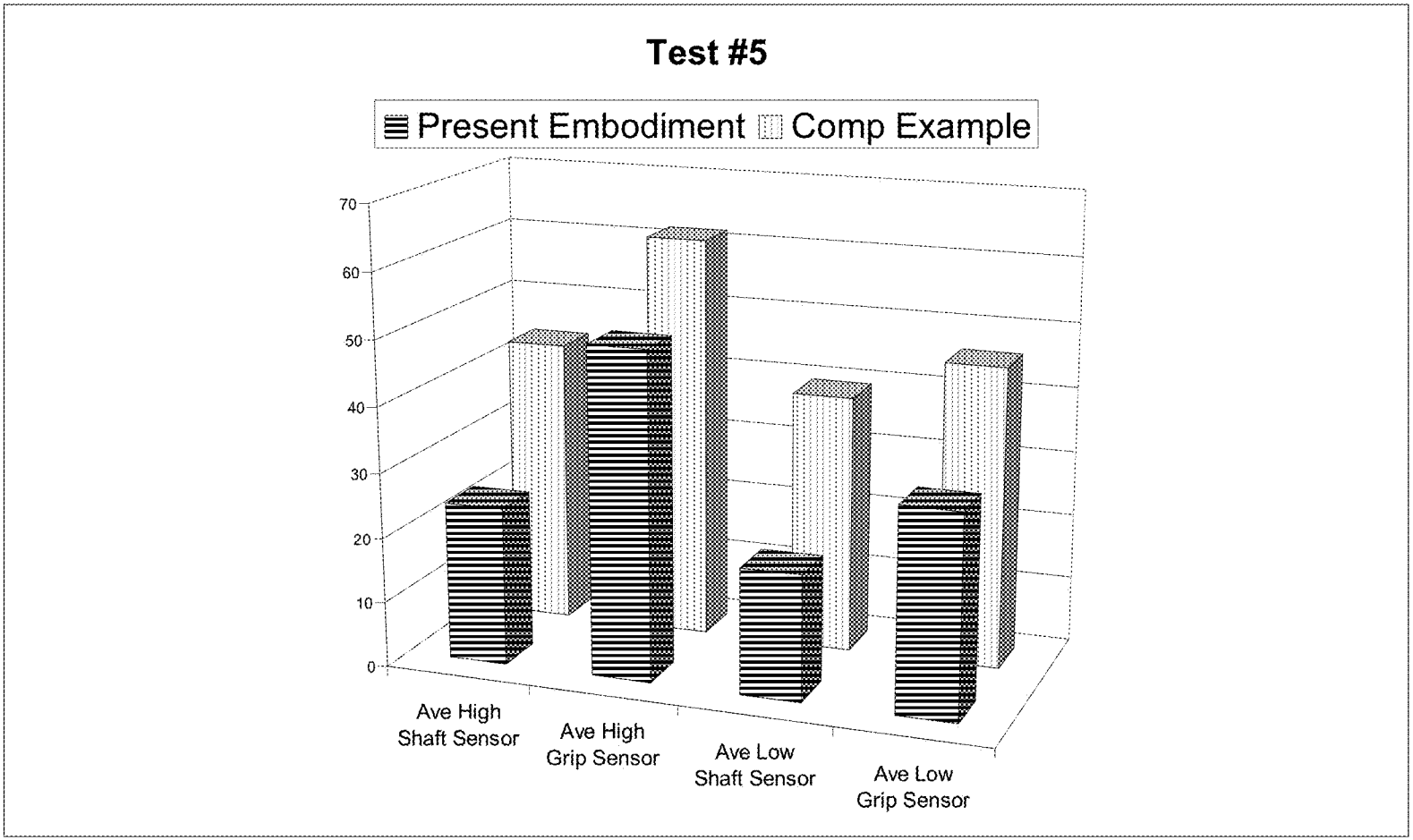
FIG. 21 shows test data associated with an embodiment of the present golf grip compared with that of a competitor's golf grip.
Figure 22:
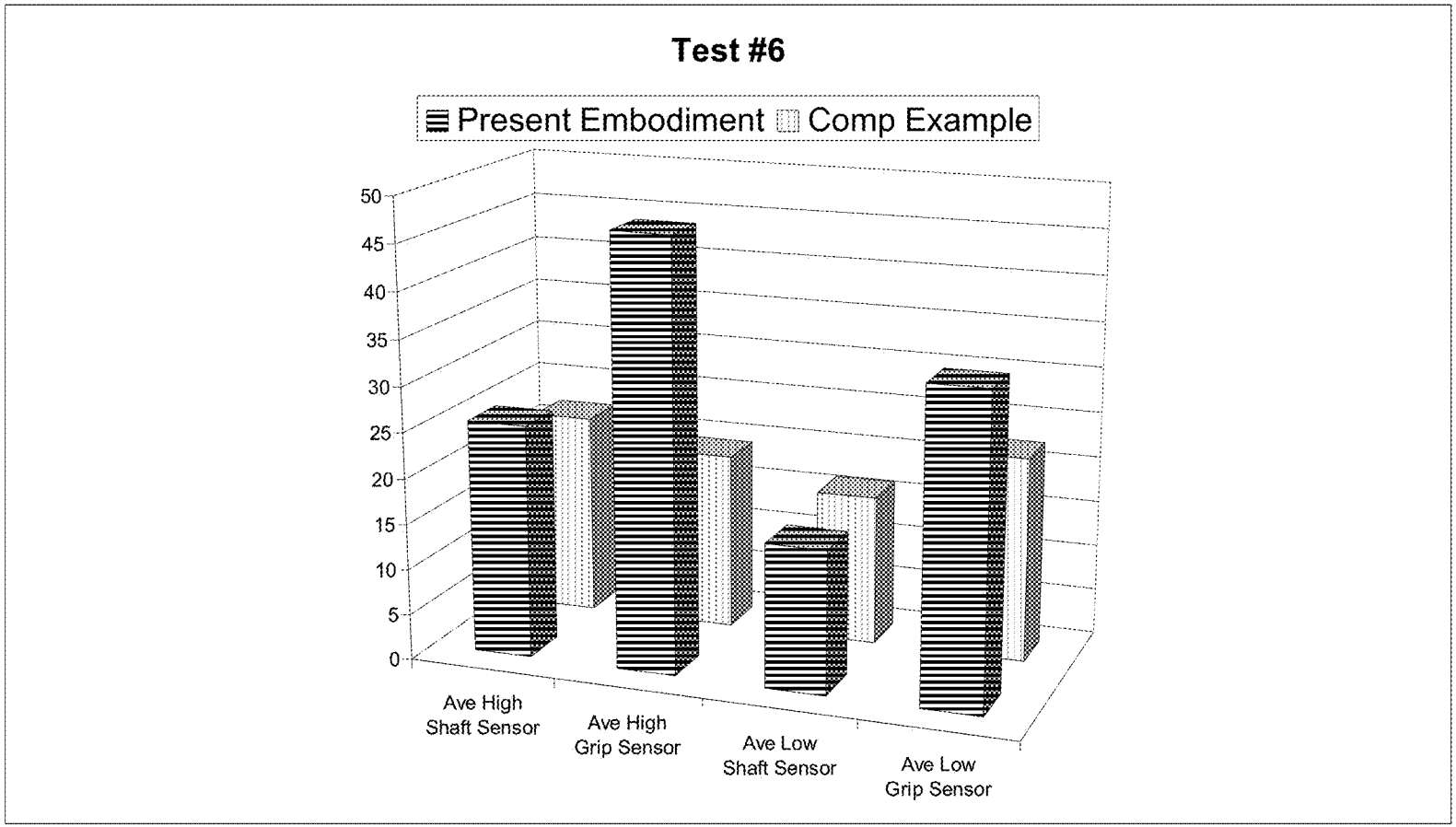
FIG. 22 shows test data associated with an embodiment of the present golf grip compared with that of a competitor's golf grip.
Figure 23:
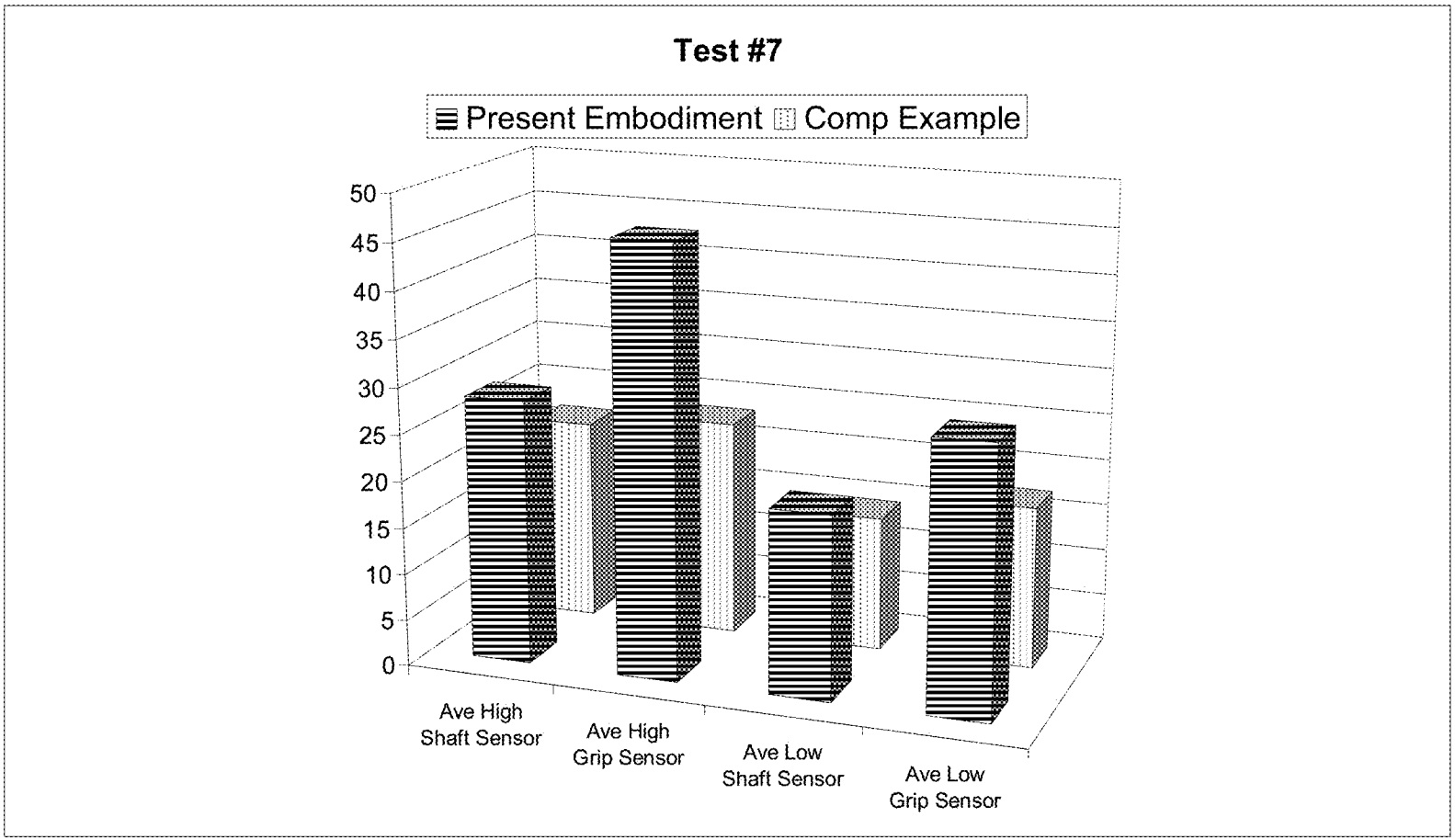
FIG. 23 shows test data associated with an embodiment of the present golf grip compared with that of a competitor's golf grip.
Figure 24:
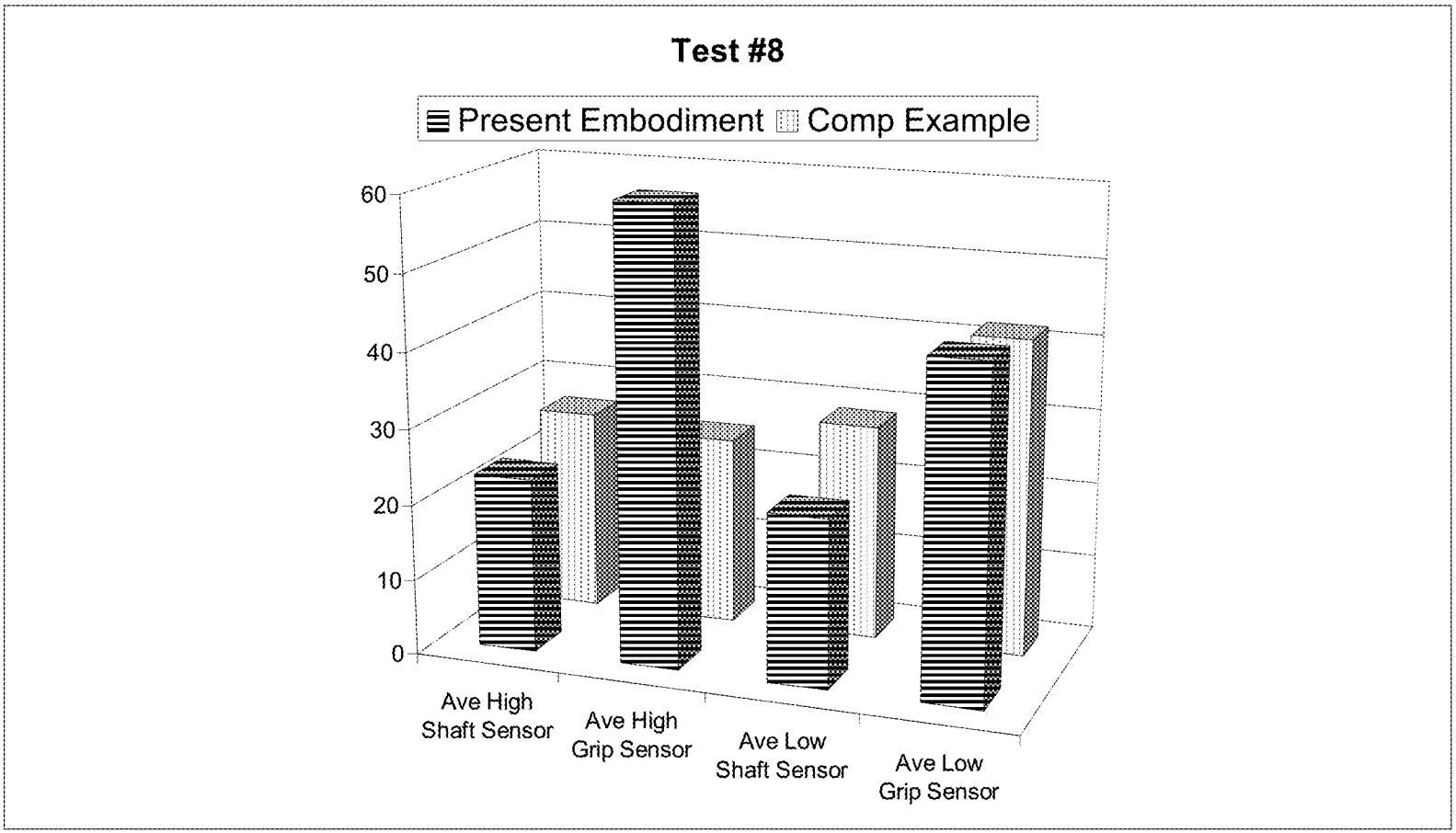
FIG. 24 shows test data associated with an embodiment of the present golf grip compared with that of a competitor's golf grip.
Figure 25:
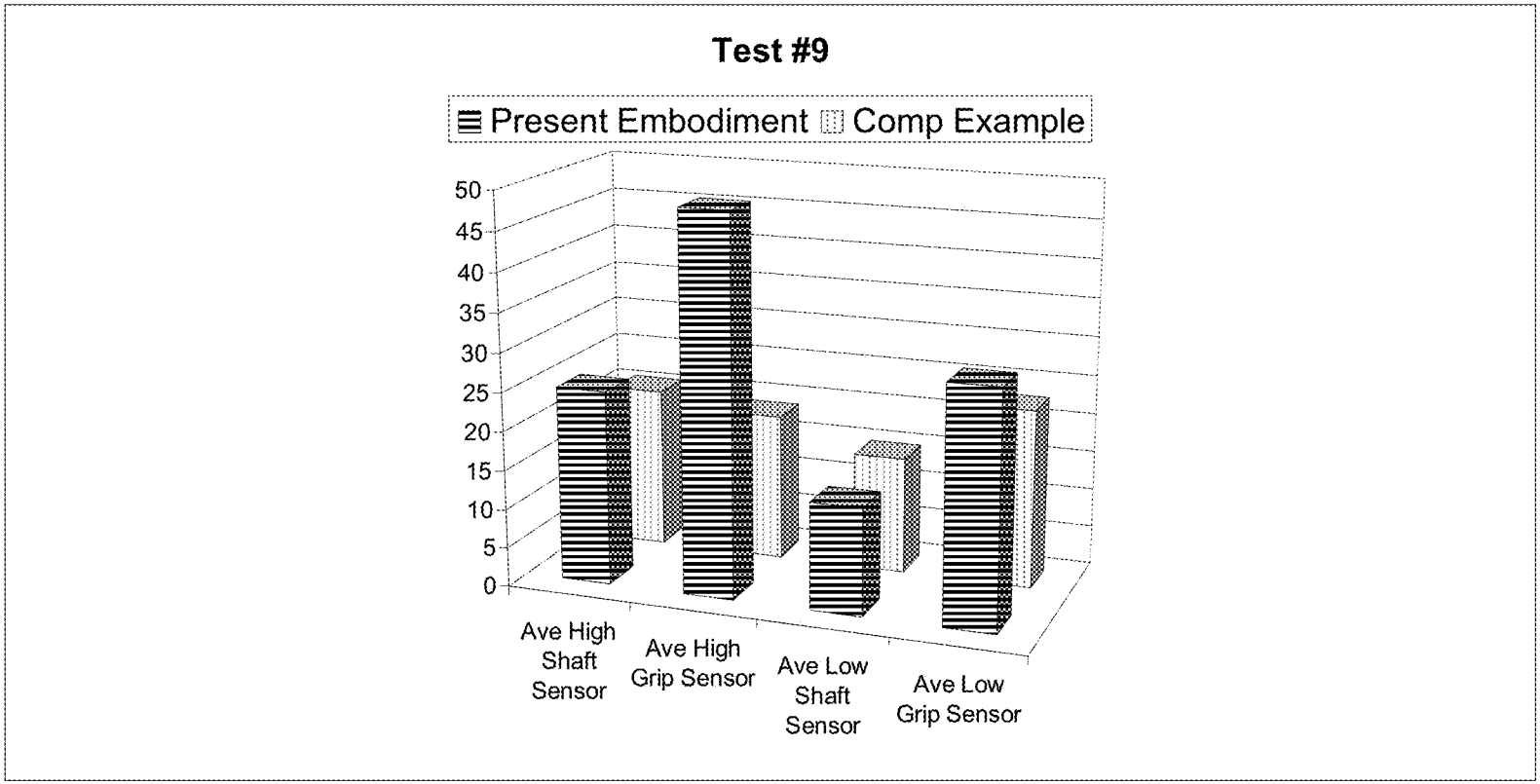
FIG. 25 shows test data associated with an embodiment of the present golf grip compared with that of a competitor's golf grip.
Figure 26:
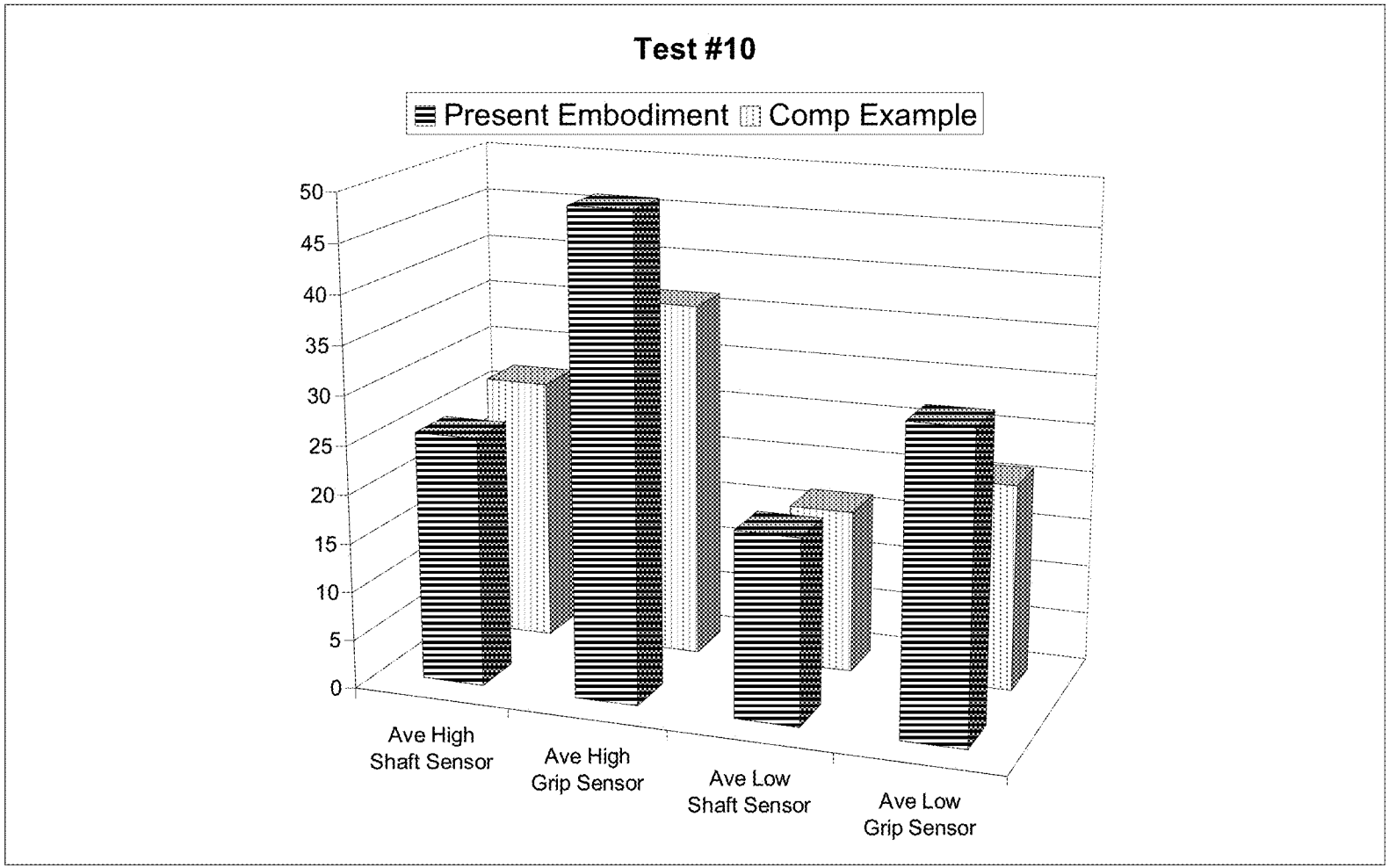
FIG. 26 shows test data associated with an embodiment of the present golf grip compared with that of a competitor's golf grip.

For the purposes of explanation, only the test data collected in test #1, seen Table 1 below and graphically represented in FIG. 17, will be discussed in detail. For the first tester ten putts were recorded. For each putt the peak positive amplitude and the peak negative amplitude of vibration in the range of 200-1000 Hz were measured at each sensor. Thus, a high, or positive, peak amplitude, and a low, or negative, peak amplitude measured by the shaft sensor (SS) and the grip sensor (GS) were recorded, for both grips. These measurements correspond to the "high" and the "low" columns in Table 1, although the "low" values are shown in the table without a negative sign, and they are illustrated in the figures as positive for graphical simplicity. An average for each column was determined, thus each golf grip has a shaft sensor average high value, a shaft sensor average low value, a grip sensor average high value, and a grip sensor average low value, which are the values graphically represented in FIG. 17. The sum of the shaft sensor average high value and the shaft sensor average low value was determined to reflect the average total amplitude, as was the sum of the grip sensor average high value and the grip sensor average low value. This was repeated for both grips. Then grip sensor sum was compared to the shaft sensor sum via the relationship: (Sum GS−Sum SS)/((Sum GS)*100), to produce a percentage indicating the energy transmission to the grip sensor (GS). As seen in Table 1 below this measure of amplification for the "Present Embodiment" grip is 94%, while it is 14% for the "Comp Example" grip. The range of 200-1000 Hz because the human hand is sensitive to vibrations in this range, with peak sensitivity in the range of 300-500 Hz.

TABLE 1

| Impact | Present Embodiment | | | | Comp Embodiment | | | |
|---|---|---|---|---|---|---|---|---|
| | Shaft Sensor (SS) | | Grip Sensor (GS) | | Shaft Sensor (SS) | | Grip Sensor (GS) | |
| # | high | low | high | low | high | low | high | low |
| 1 | 25.99 | 15.24 | 48.68 | 26.98 | 29.36 | 24.3 | 23.61 | 38.21 |
| 2 | 23.22 | 12.23 | 43.4 | 27.34 | 28.75 | 16.21 | 23.12 | 28.48 |
| 3 | 27.78 | 16.2 | 52.77 | 29.44 | 21.25 | 11.47 | 17.4 | 16.04 |
| 4 | 18.24 | 9.81 | 33.91 | 20.24 | 31.46 | 34.74 | 25.3 | 48.88 |
| 5 | 32.38 | 18.47 | 60.88 | 34 | 18.94 | 10.83 | 14.57 | 12.84 |
| 6 | 22.51 | 12.43 | 41.98 | 25.77 | 35.49 | 33.83 | 30.04 | 50.81 |
| 7 | 25.02 | 13.86 | 47.51 | 31.3 | 29.39 | 25.9 | 24.24 | 39.72 |
| 8 | 30.26 | 16.43 | 57.5 | 37.36 | 26.31 | 22.99 | 21.18 | 35.42 |
| 9 | 25.29 | 13.01 | 47.46 | 29.64 | 36.39 | 34.4 | 31.81 | 52.59 |
| 10 | 37.21 | 20.72 | 70.31 | 40.44 | 29.83 | 26.6 | 24.98 | 42.01 |
| Avg | 26.79 | 14.84 | 50.44 | 30.251 | 28.72 | 24.13 | 23.63 | 36.50 |
| | Average Total Amplitude = Sum of High Ave and Low Ave | | | | | | | |
| | 41.63 | | 80.691 | | 52.85 | | 60.13 | |
| | Amplification = (Sum GS − Sum SS)/Sum GS * 100 | | | | | | | |
| | 94% | | | | 14% | | | |

Table 2 below shows the amplification for the "Present Embodiment" grip, abbreviated PE, and the "Comp Example" grip, abbreviated CE, for each of the ten testers.

TABLE 2

| | Amplification | | | | | | | | | |
|---|---|---|---|---|---|---|---|---|---|---|
| | 1 | 2 | 3 | 4 | 5 | 6 | 7 | 8 | 9 | 10 |
| PE Grip | 94 | 89 | 87 | 79 | 87 | 96 | 55 | 91 | 103 | 80 |
| CE Grip | 14 | 73 | 16 | 16 | 29 | 9 | 12 | 21 | 17 | 32 |

Further, the data for the 5 most experienced golfers was also analyzed using the average force recorded by the shaft sensor (SS) and the grip sensor (GS), as seen below in Tables 3 and

TABLE 3

| "Present Embodiment" Grip | | | | |
|---|---|---|---|---|
| | Average Force Recorded by Shaft Sensor: | Standard Deviation: | Average Force Recorded by Grip Sensor: | Percentage increase grip vs shaft (transmissibility) |
| Test #1 | 41.63 g's | 8.62 g's | 80.49 g's | 193.8% |
| Test #2 | 26.15 g's | 8.20 g's | 49.49 g's | 189.2% |
| Test #3 | 39.22 g's | 18.05 g's | 73.40 g's | 187.1% |
| Test #4 | 49.06 g's | 11.93 g's | 87.98 g's | 179.3% |
| Test #9 | 39.53 g's | 14.51 g's | 78.69 g's | 199.1% |

TABLE 4

| "Comp Example" Grip | | | | |
|---|---|---|---|---|
| | Average Force Recorded by Shaft Sensor: | Standard Deviation: | Average Force Recorded by Grip Sensor: | Percentage increase grip vs shaft (transmissibility) |
| Test #1 | 52.84 g's | 14.16 g's | 60.13 g's | 113.8% |
| Test #2 | 35.42 g's | 18.34 g's | 38.62 g's | 109.0% |
| Test #3 | 28.61 g's | 15.13 g's | 33.10 g's | 115.7% |
| Test #4 | 34.24 g's | 15.49 g's | 39.75 g's | 116.1% |
| Test #9 | 35.72 g's | 21.41 g's | 41.84 g's | 117.7% |

This average force recorded by the shaft sensor (SS) and the grip sensor (GS) methodology is easily replicated using any pendulum type putter testing machine. For instance, the "iron archie" putting robot from The Putting Arc, Inc. of Jackson, Miss. may be used to independently obtain the previously discussed amplification and transmissibility. Using this device also allows the data collected by the grip sensor (GS) and the shaft sensor (SS) to not be influenced by a golfer's hands on the golf grip (10), as minimal as this influence may be. First, the previously described sensors are attached in the specified locations on the shaft (S) and the golf grip (10). Then, since different machines may vary and different putters have varying weight, testing is performed to determine the backswing position that when released allows the putter head to accelerate to impact a golf ball with an input force measured by the shaft sensor (SS) of 30 g's. This backswing position is recorded and used as the starting point for the robot testing. Next, a series of 10 putts are hit with the putter being released from the predetermined backswing position and the grip sensor (GS) records the vibration force response, in the 200-1000 Hz range, on the golf grip (10), while the shaft sensor (SS) records the input vibration force response, in the 200-1000 Hz range. The average force recorded by shaft sensor (SS) and the average force recorded by the grip sensor (GS) are determined and used to calculate the transmissibility, just as in Table 4. In one embodiment the golf grip (10) has a transmissibility of at least 120%, whereas in a further embodiment the golf grip (10) has a transmissibility of at least 140%, and in an even further embodiment the transmissibility is at least 160%, and yet another embodiment has a transmissibility of at least 180%.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. Further, the use of exterior surface (110) throughout does not preclude a cosmetic or decorative coating of 1 mm thickness, or less, over the structural exterior surface (110). The corresponding structures, materials, acts, and equivalents of all means or step plus function elements in the claims below are intended to include any structure, material, or acts for performing the functions in combination with other claimed elements as specifically claimed.

We claim:

1. A golf grip, comprising:

an elongated tubular body having an exterior surface, an interior surface, a butt end, a tip end, a length from the butt end to the tip end, and the golf grip has an overall density;

wherein a point along the length has a cross-section having a cross-sectional area, an exterior cross-sectional radius having a minimum exterior cross-sectional radius, and an interior surface radius having a minimum interior surface radius;

wherein the cross-section includes a first region, and a second region, the first region extending outward from the interior surface a first region thickness that is constant around interior surface, and thereby defining the second region as the balance of the cross-section between the exterior surface and the first region, wherein the first region thickness is equal to one-half of a difference between the minimum exterior cross-sectional radius and the minimum interior surface radius;

wherein a first region average density is determined for a first region test volume bounded by the interior surface, the second region, the cross-section, and an offset cross-section that is parallel to the cross-section and 1 cm away from the cross-section;

wherein a second region average density is determined for a second region test volume bounded by the exterior surface, the first region, the cross-section, and the offset cross-section;

wherein the first region average density is less than 0.6 g/cc and is less than the second region average density; and wherein the elongated tubular body is formed of at least a first inner layer, having a first layer thickness, a first layer density, and a first layer quantity of blowing agent, and a second outer layer, having second layer thickness and a second layer density, wherein the first layer density is different than the second layer density, wherein the first inner layer and the second outer layer consist of rubber compounds cross-linked together under heat and pressure.

2. The golf grip of claim 1, wherein the overall density of the golf grip is at least 0.45-0.65 g/cc.

3. The golf grip of claim 2, wherein the first region average density is less than 75% of the second region average density.

4. The golf grip of claim 3, wherein the first layer thickness is different than the second layer thickness.

5. The golf grip of claim 1, wherein the second region average density is at least 50% greater than the first region average density.

6. The golf grip of claim 5, wherein the second region average density is no more than 300% greater than the first region average density.

7. The golf grip of claim 6, wherein the second outer layer has a second layer quantity of blowing agent different than the first quantity of blowing agent.

8. The golf grip of claim 7, wherein the first layer quantity of blowing agent is at least twice the second layer quantity of blowing agent.

9. The golf grip of claim 1, wherein the first layer has a first layer hardness of at least 55 Shore A prior to compression molding, and the second layer has a second layer hardness prior to compression molding that is different than the first layer hardness.

10. The golf grip of claim 9, wherein second layer hardness is less than the first layer hardness.

11. The golf grip of claim 3, wherein the first region average density is less than 50% of the second region average density.

12. The golf grip of claim 1, wherein the first region average density no greater than 0.6 g/cc and the second region average density is at least 0.8 g/cc.

13. The golf grip of claim 4, wherein the first layer thickness is no greater than 3.0 mm, and the second layer thickness is no greater than 2.5 mm.

14. A golf grip, comprising:

an elongated tubular body having an exterior surface, an interior surface, a butt end, a tip end, a length from the butt end to the tip end, and the golf grip has an overall density of 0.45-0.65 g/cc;

wherein a point along the length has a cross-section having a cross-sectional area, an exterior cross-sectional radius having a minimum exterior cross-sectional radius, and an interior surface radius having a minimum interior surface radius;

wherein the cross-section includes a first region, and a second region, the first region extending outward from the interior surface a first region thickness that is constant around interior surface, and thereby defining the second region as the balance of the cross-section between the exterior surface and the first region, wherein the first region thickness is equal to one-half of a difference between the minimum exterior cross-sectional radius and the minimum interior surface radius;

wherein a first region average density is determined for a first region test volume bounded by the interior surface, the second region, the cross-section, and an offset cross-section that is parallel to the cross-section and 1 cm away from the cross-section;

wherein a second region average density is determined for a second region test volume bounded by the exterior surface, the first region, the cross-section, and the offset cross-section;

wherein the first region average density is less than the second region average density, and the first region average density is less than 0.6 g/cc; and wherein the first region and the second region include rubber compounds with at least one rubber compound containing a blowing agent.

15. The golf grip of claim 14, wherein the first region average density is less than 75% of the second region average density.

16. The golf grip of claim 15, wherein the second region average density is 50-300% greater than the first region average density.

17. The golf grip of claim 16, wherein the second region average density is at least 0.8 g/cc.

18. The golf grip of claim 17, wherein the first region includes a first blowing agent at a first blowing agent quantity, and the second region includes a second blowing agent at a second blowing agent quantity that is different than the first blowing agent quantity.

19. A golf grip, comprising:

an elongated tubular body having an exterior surface, an interior surface, a butt end, a tip end, a length from the butt end to the tip end, and the golf grip has an overall density of 0.45-0.65 g/cc;

wherein a point along the length has a cross-section having a cross-sectional area, an exterior cross-sectional radius having a minimum exterior cross-sectional radius, and an interior surface radius having a minimum interior surface radius;

wherein the cross-section includes a first region, and a second region, the first region extending outward from the interior surface a first region thickness that is constant around interior surface, and thereby defining the second region as the balance of the cross-section between the exterior surface and the first region, wherein the first region thickness is equal to one-half of a difference between the minimum exterior cross-sectional radius and the minimum interior surface radius;

wherein a first region average density is determined for a first region test volume bounded by the interior surface, the second region, the cross-section, and an offset cross-section that is parallel to the cross-section and 1 cm away from the cross-section;

wherein a second region average density is determined for a second region test volume bounded by the exterior surface, the first region, the cross-section, and the offset cross-section;

wherein the first region average density is less than 0.6 g/cc and the second region average density is at least 0.8 g/cc; and wherein the elongated tubular body is formed of at least (a) a first inner layer, having a first layer thickness, a first layer density, and a first layer hardness, and (b) a second outer layer, having second layer thickness, a second layer density, and a second layer hardness different from the first layer hardness, wherein the first layer density is different than the second layer density, wherein the first inner layer and the second outer layer consist of rubber compounds cross-linked together under heat and pressure.

20. The golf grip of claim 19, wherein the second region average density is 50-300% greater than the first region average density, and the first inner layer has a first layer quantity of blowing agent.

* * * * *